US006331386B1

(12) United States Patent
Ezoe et al.

(10) Patent No.: US 6,331,386 B1
(45) **Date of Patent: *Dec. 18, 2001**

(54) PHOTOTHERMOGRAPHIC ELEMENT

(75) Inventors: Toshihide Ezoe; Kohzaburoh Yamada, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/300,837

(22) Filed: Apr. 28, 1999

(30) Foreign Application Priority Data

May 11, 1998 (JP) ..... 10-145059
Jul. 13, 1998 (JP) ..... 10-213487

(51) Int. Cl.[7] ..... G03C 1/498; G03C 1/34

(52) U.S. Cl. ..... 430/619; 430/264; 430/531; 430/607; 430/613; 430/614; 430/615

(58) Field of Search ..... 430/619, 617, 430/264, 607, 613, 614, 615, 531

(56) References Cited

U.S. PATENT DOCUMENTS 4,123,274 10/1978 Knight et al. .
5,545,515 * 8/1996 Murray et al. ..... 430/617

FOREIGN PATENT DOCUMENTS

762196A1 3/1997 (EP) .
0897130 * 2/1999 (EP) .
53116144 10/1978 (JP) .
58 28737 2/1983 (JP) .
60 61747 4/1985 (JP) .

* cited by examiner

*Primary Examiner*—Thorl Chea
(74) *Attorney, Agent, or Firm*—Birch, Stewart, Kolasch & Birch, LLP

(57) ABSTRACT

A photothermographic element has a non-photosensitive organic silver salt, a photosensitive silver halide, and a binder on a support. A polymer latex constitutes at least 50% by weight of the binder in an image forming layer containing the photosensitive silver halide. The image forming layer has been formed by applying a coating solution in which at least 60% by weight of a solvent is water. The image forming layer contains a specific compound as a nucleating agent and has been formed by applying a coating solution having added thereto a water dispersion of the compound. The element exhibits a high contrast, long-term storage stability, and no increase of Dmin upon printing to PS plates.

7 Claims, 1 Drawing Sheet

PHOTOTHERMOGRAPHIC ELEMENT

This invention relates to a photothermographic element, and more particularly, to a photothermographic element suitable for use in a photomechanical process and especially adapted for scanners and image setters. More specifically, it relates to such a photothermographic element for use in a photomechanical process and capable of forming images with a high maximum density (Dmax).

BACKGROUND OF THE INVENTION

One well-known method for the exposure of photographic photosensitive elements is an image forming method of the scanner system comprising the steps of scanning an original to produce image signals, subjecting a photographic silver halide photosensitive element to exposure in accordance with the image signals, and forming a negative or positive image corresponding to the image of the original.

There is a desire to have a procedure of providing outputs of a scanner to a film and directly printing on a printing plate without a transfer step as well as a scanner photosensitive element having an ultrahigh contrast and high Dmax with respect to a scanner light source having a soft beam profile. It is well known to utilize the nucleation infectious development using hydrazine derivatives.

There are known a number of photosensitive elements having a photosensitive layer on a support wherein images are formed by imagewise exposure. Among these, a technique of forming images through heat development is known as a system capable of simplifying image forming means and contributing to the environmental protection.

From the contemporary standpoints of environmental protection and space saving, it is strongly desired in the photomechanical process field to reduce the quantity of spent solution. Needed in this regard is a technology relating to photothermographic elements for use in photomechanical process which can be effectively exposed by means of laser scanners or laser image setters and produce distinct black images having a high resolution and sharpness. These photothermographic elements offer to the customer a simple thermographic system that eliminates a need for wet chemical agents and is not detrimental to the environment.

The technology of forming images through heat development is disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969. These photothermographic elements generally contain a reducible non-photosensitive silver source (e.g., organic silver salt), a catalytic amount of a photocatalyst (e.g., silver halide), and a reducing agent for silver, typically dispersed in an organic binder matrix. Photothermographic elements are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the reducible silver salt in exposed regions provides black images in contrast to unexposed regions, forming an image.

Photothermographic elements of this type are well known in the art. In most of these elements, photosensitive layers are formed by applying coating solutions based on organic solvents such as toluene, methyl ethyl ketone (MEK) and methanol, followed by drying.

It was also contemplated to form photosensitive layers using coating solutions based on water. Such photosensitive layers are sometimes referred to as "aqueous photosensitive layers," hereinafter. For example, JP-A 52626/1974 and 116144/1978 disclose the use of gelatin as the binder. JP-A 151138/1975 discloses polyvinyl alcohol as the binder. Further, JP-A 61747/1985 discloses a combined use of gelatin and polyvinyl alcohol. Besides, JP-A 28737/1983 discloses a photosensitive layer containing water-soluble polyvinyl acetal as the binder.

EP 762,196 and JP-A 90550/1997 disclose that photothermographic image-recording elements exhibit high-contrast photographic properties when photosensitive silver halide grains contain metal ions or metal complex ions belonging to Group VII or VIII (Group 7 to 10) in the Periodic Table and the photothermographic elements contain hydrazine derivatives.

It is known for photothermographic elements that the use of hydrazine derivatives achieves sufficient properties including high contrast and high Dmax for use in the photomechanical process. On the other hand, the use of hydrazine derivatives has serious drawbacks in practical use including a decline of Dmax during long-term storage and an increase of Dmin (minimum density) upon printing to presensitized (PS) plates.

SUMMARY OF THE INVENTION

Therefore, an object of the invention is to provide a photothermographic element suitable for use in a photomechanical process and exhibiting excellent properties including a high contrast, long-term storage stability, and no increase of Dmin upon printing to PS plates.

According to the invention, there is provided a photothermographic element comprising a non-photosensitive organic silver salt, a photosensitive silver halide formed independent of the non-photosensitive organic silver salt, and a binder on a support. A polymer latex constitutes at least 50% by weight of the binder in an image forming layer on one surface of the support containing the photosensitive silver halide. The image forming layer has been formed by applying a coating solution in which at least 60% by weight of a solvent is water. The image forming layer or another layer on the one surface of the support contains at least one compound selected from compounds of the following formulae (A) and (B) and has been formed by applying a coating solution having added thereto a water dispersion of the compound. formula (A)

formula (A)

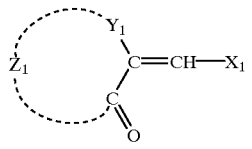

In formula (A), $Z_1$ is a group of non-metallic atoms completing a 5- to 7-membered cyclic structure, $Y_1$ is —C(=O)— or —$SO_2$—, $X_1$ is —O.(1/k)M or —S.(1/k)M, M is a cation, and k is the valence of M.

formula (B)

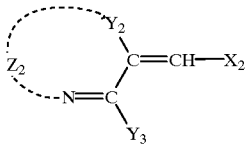

In formula (B), $Z_2$ is a group of non-metallic atoms completing a 5- to 7-membered cyclic structure, $Y_2$ is —C(=O)— or —$SO_2$—, $X_2$ is —O.(1/k)M or —S.(1/k)M, M is a cation, k is the valence of M, and $Y_3$ is hydrogen or a substituent.

Preferably, the compound of formula (A) has at least 6 carbon atoms in total and the compound of formula (B) has at least 12 carbon atoms in total. Preferably, the compound of formula (A) or (B) has been added to the coating solution as a water dispersion free of a surfactant.

The preferred polymer latex is a latex of a polymer having a glass transition temperature of −30° C. to 40° C.

BRIEF DESCRIPTION OF THE DRAWING

The only figure.

DETAILED DESCRIPTION OF THE INVENTION

Figure 1:
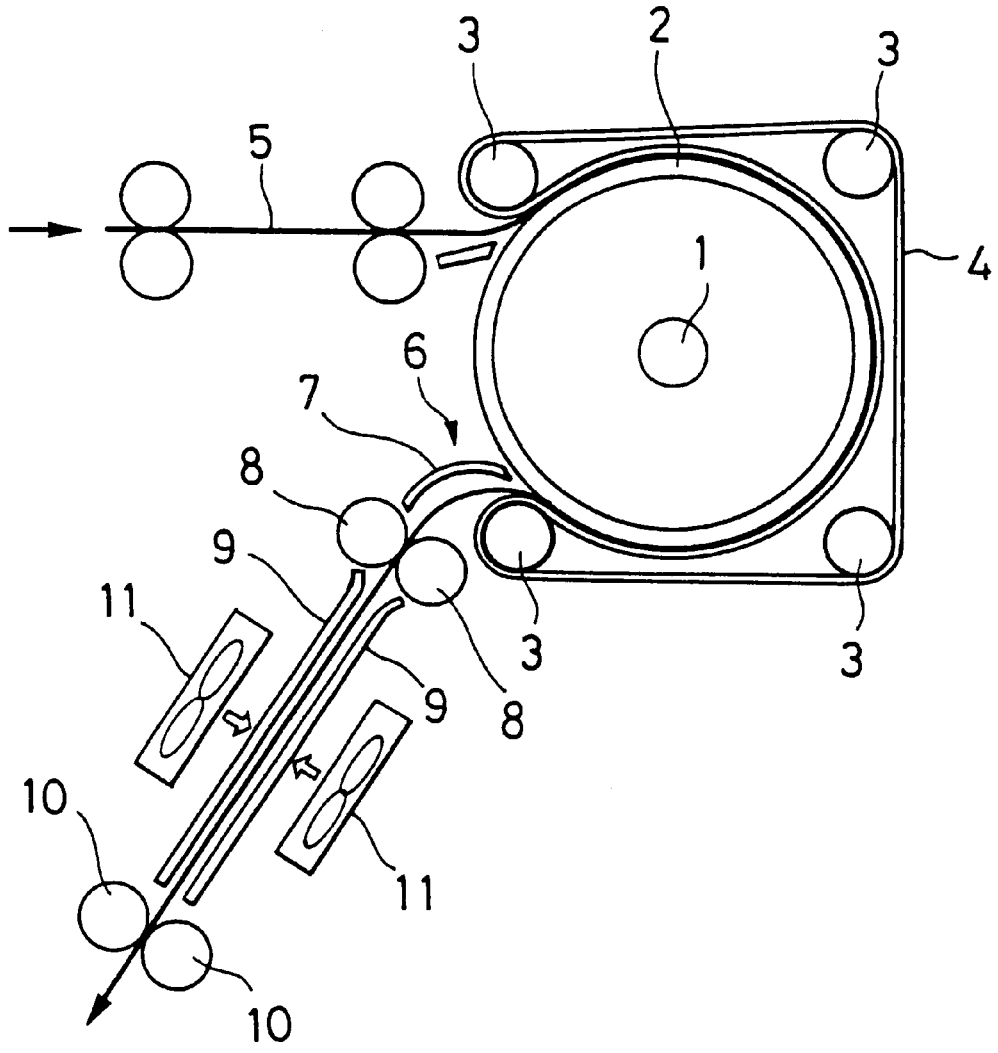
FIG. 1 is a schematic view of one exemplary heat developing apparatus for use in the processing of the photothermographic element according to the invention.

The photothermographic (or photosensitive heat developable) element of the invention contains a non-photosensitive organic silver salt, a photosensitive silver halide, and a binder on a support. The silver halide emulsion has been formed independent of the organic silver salt, for the purpose of improving photographic properties as will be described later. The element has an image forming layer (or photosensitive layer) containing the photosensitive silver halide and a binder on one surface of the support while a polymer latex enabling environmentally and economically advantageous aqueous coating is used in an amount of at least 50% by weight of the binder. The polymer of the polymer latex should preferably have a glass transition temperature (Tg) of −30° C. to 40° C. for the purpose of achieving better properties. In this photosensitive element, a layer is formed using a coating solution to which the compound of formula (A) or (B) is added as a water dispersion such as a micelle dispersion, emulsified dispersion or solid dispersion whereby the compound of formula (A) or (B) is incorporated as a nucleating agent in the image forming layer or another layer on the one surface of the support. There is obtained a photothermographic element exhibiting excellent properties including a high contrast, long-term storage stability, and no increase of minimum density (Dmin) upon printing to PS plates. The compounds of formulas (A) and (B) are structurally characterized in that they are alkene derivatives having a cation and a cyclic ketone or nitrogenous heterocycle. By contrast, analogous cyclic compounds free of a cation or cation-containing alkene compounds free of a cyclic structure allow photographic properties to degrade during storage and Dmin to increase upon printing to PS plates.

The compounds of formulas (A) and (B) are insoluble in organic solvents such as methanol and inadequate for solution addition using organic solvents and thus used as a water dispersion wherein water is the primary solvent or dispersing medium. Better results are obtained when the compounds are used as a water dispersion free of a surfactant. By contrast, alkene derivatives of the structure falling outside the scope of formulae (A) and (B) are difficult to form a water dispersion by micelle dispersion partially because of solubility, and must be added by another method, with which the benefits of the invention are unachievable.

Organic Silver Salt

The non-photosensitive organic silver salt used herein is a silver salt which is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. The silver-providing substance preferably constitutes about 5 to 70% by weight of the image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver arachidate, silver stearate, silver oleate, silver laurate, silver caproate, silver myristate, silver palmitate, silver maleate, silver fumarate, silver tartrate, silver linolate, silver butyrate, silver camphorate and mixtures thereof.

Typically, the organic acid silver used herein is formed by reacting silver nitrate with a solution or suspension of an alkali metal salt (e.g., sodium, potassium or lithium salt) of an organic acid. The organic acid alkali metal salt is obtained by treating the above-described organic acid with an alkali. The preparation of the organic acid silver may be carried out in any suitable reactor in a batchwise or continuous manner. Agitation in the reactor may be carried out by any desired method depending on the characteristics required for organic acid silver grains. The organic acid silver may be prepared by a method of slowly or rapidly adding an aqueous solution of silver nitrate to a reactor charged with a solution or suspension of an organic acid alkali metal salt; a method of slowly or rapidly adding a preformed solution or suspension of an organic acid alkali metal salt to a reactor charged with an aqueous solution of silver nitrate; or a method of simultaneously adding a preformed aqueous solution of silver nitrate and a preformed solution or suspension of an organic acid alkali metal salt to a reactor.

As to the addition of the silver nitrate aqueous solution and the organic acid alkali metal salt solution or suspension, both the solutions may have any suitable concentrations for the desired grain size of the organic acid silver grains to be formed therefrom. They may be added at any desired rates. A constant addition method of adding them at a constant rate or an accelerated or decelerated addition method of accelerating or decelerating the addition rate as a function of time may be employed. The solutions may be added to or below the surface of the reaction solution. In the method of simultaneously adding a preformed silver nitrate aqueous solution and a preformed organic acid alkali metal salt solution or suspension to a reactor, either one of the solutions may be partially added in advance. Preferably the silver nitrate aqueous solution is added in advance. An appropriate amount of one solution added in advance of the other solution is 0 to 50%, more preferably 0 to 25% by volume of the entirety. As described in JP-A 127643/1997, it is also preferable to add both the solutions while controlling the pH or silver potential of the reaction solution.

The silver nitrate aqueous solution and the organic acid alkali metal salt solution or suspension may be adjusted to suitable pH levels depending on the desired characteristics required for the organic acid silver grains. For pH adjustment, any suitable acid or alkali may be added. Depending on the characteristics required for the organic acid silver grains, for example, for controlling the size of organic acid silver grains, the temperature in the reactor may be set at a suitable level. Similarly, the temperatures of the silver nitrate aqueous solution and the organic acid alkali metal salt solution or suspension to be added may also be set at suitable levels. Typically, the organic acid alkali metal salt solution or suspension is heated and maintained at or above 50° C. in order to keep it flowable.

Preferably, the organic acid silver used herein is prepared in the presence of a tertiary alcohol. The tertiary alcohols used herein are preferably those of up to 15 carbon atoms in total, more preferably up to 10 carbon atoms in total. Tert-butanol is the preferred tertiary alcohol although the invention is not limited thereto.

The tertiary alcohol may be added at any stage during preparation of the organic acid silver. Preferably the tertiary alcohol is added during preparation of an organic acid alkali metal salt whereby the organic acid alkali metal salt is dissolved in the alcohol. The amount of the tertiary alcohol used is such that the weight ratio of tertiary alcohol to water may fall in the range from 0.01 to 10 provided that water ($H_2O$) is used as the solvent during preparation of the organic acid silver. The preferred weight ratio of tertiary alcohol to water falls in the range from 0.03 to 1.

The organic silver salt which can be used herein may take any desired shape although needle crystals having a minor axis and a major axis are preferred. In the practice of the invention, grains should preferably have a minor axis or breadth of 0.01 $\mu$m to 0.20 $\mu$m and a major axis or length of 0.10 $\mu$m to 5.0 $\mu$m, more preferably a minor axis of 0.01 $\mu$m to 0.15 $\mu$m and a major axis of 0.10 $\mu$m to 4.0 $\mu$m. The grain size distribution of the organic silver salt is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image of a grain dispersion obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the auto-correlation function of the fluctuation of scattering light relative to a time change, and obtaining the grain size (volume weighed mean diameter) therefrom.

The organic silver salt used herein is preferably desalted. The desalting method is not critical. Any well-known method may be used although well-known filtration methods such as centrifugation, suction filtration, ultrafiltration, and flocculation/water washing are preferred.

For the purpose of obtaining a solid particle dispersion of an organic silver salt having a high S/N ratio and a small particle size and free of agglomeration, use is preferably made of a dispersion method involving the steps of converting a water dispersion containing an organic silver salt as an image forming medium, but substantially free of a photosensitive silver salt into a high pressure, high speed flow, and causing a pressure drop to the flow. Thereafter, the dispersion is mixed with an aqueous solution of a photosensitive silver salt, thereby preparing a photo-sensitive image forming medium coating solution.

When a photothermographic element is prepared using this coating solution, the resulting photothermographic image forming element has a low haze, low fog and high sensitivity. In contrast, if a photosensitive silver salt is co-present when an organic silver salt is dispersed in water by converting into a high pressure, high speed flow, then there result a fog increase and a substantial sensitivity decline. If an organic solvent is used instead of water as the dispersing medium, then there result a haze increase, a fog increase and a sensitivity decline. If a conversion technique of converting a portion of an organic silver salt in a dispersion into a photosensitive silver salt is employed instead of mixing a photosensitive silver salt aqueous solution, then there results a sensitivity decline.

The water dispersion which is dispersed by converting into a high pressure, high speed flow should be substantially free of a photosensitive silver salt. The content of photosensitive silver salt is less than 0.1 mol% based on the non-photosensitive organic silver salt. The positive addition of photosensitive silver salt is avoided.

With respect to the solid dispersing technology and apparatus employed in carrying out the above-described dispersion method of the invention, reference should be made to Kajiuchi and Usui, "Dispersed System Rheology and Dispersing Technology," Shinzansha Publishing K.K., 1991, pp. 357–403; and Tokai Department of the Chemical Engineering Society Ed., "Progress of Chemical Engineering, Volume 24," Maki Publishing K.K., 1990, pp. 184–185. According to the dispersion method recommended above, a water dispersion liquid containing at least an organic silver salt is pressurized by a high pressure pump or the like, fed into a pipe, and passed through a narrow slit in the pipe whereupon the dispersion liquid is allowed to experience an abrupt pressure drop, thereby accomplishing fine dispersion.

Such a high pressure homogenizer which is used in the practice of the invention is generally believed to achieve dispersion into finer particles under the impetus of dispersing forces including (a) "shear forces" exerted when the dispersed phase is passed through a narrow gap under high pressure and at a high speed and (b) "cavitation forces" exerted when the dispersed phase under high pressure is released to atmospheric pressure. As the dispersing apparatus of this type, Gaulin homogenizers are known from the past. In the Gaulin homogenizer, a liquid to be dispersed fed under high pressure is converted into a high-speed flow through a narrow slit on a cylindrical surface and under that impetus, impinged against the surrounding wall surface, achieving emulsification and dispersion by the impact forces. The pressure used is generally 100 to 600 kg/cm$^2$ and the flow velocity is from several meters per second to about 30 m/sec. To increase the dispersion efficiency, improvements are made on the homogenizer as by modifying a high-flow-velocity section into a saw-shape for increasing the number of impingements. Apart from this, apparatus capable of dispersion at a higher pressure and a higher flow velocity were recently developed. Typical examples of the advanced dispersing apparatus are available under the trade name of Micro-Fluidizer (Microfluidex International Corp.) and Nanomizer (Tokushu Kika Kogyo K.K.).

Examples of appropriate dispersing apparatus which are used in the practice of the invention include MicroFluidizer M-110S-EH (with G10Z interaction chamber), M-110Y (with H10Z interaction chamber), M-140K (with G10Z interaction chamber), HC-5000 (with L30Z or H230Z interaction chamber), and HC-8000 (with E230Z or L30Z interaction chamber), all available from Microfluidex International Corp.

Using such apparatus, a water dispersion liquid containing at least an organic silver salt is pressurized by a high pressure pump or the like, fed into a pipe, and passed through a narrow slit in the pipe for applying a desired pressure to the liquid and thereafter, the pressure within the pipe is quickly released to atmospheric pressure whereby the dispersion liquid experiences an abrupt pressure drop, thereby obtaining the organic silver salt dispersion for use in the invention.

Prior to the dispersing operation, the starting liquid is preferably pre-dispersed. For such pre-dispersion, there may be used any of well-known dispersing means, for example, high-speed mixers, homogenizers, high-speed impact mills, Banbury mixers, homomixers, kneaders, ball mills, vibrating ball mills, planetary ball mills, attritors, sand mills, bead mills, colloid mills, jet mills, roller mills, trommels, and high-speed stone mills. Rather than such mechanical dispersion, the pre-dispersion may be carried out by controlling the pH of the starting liquid for roughly dispersing particles in a solvent, and then changing the pH in the presence of dispersing agents for fine graining. The solvent used in the rough dispersing step may be an organic solvent although the organic solvent is usually removed after the completion of fine graining.

According to the invention, the organic silver salt dispersion can be dispersed to a desired particle size by adjusting a flow velocity, a differential pressure upon pressure drop, and the number of dispersing cycles. From the standpoints of photographic properties and particle size, it is preferable to use a flow velocity of 200 to 600 m/sec and a differential pressure upon pressure drop of 900 to 3,000 kg/cm$^2$, and especially a flow velocity of 300 to 600 m/sec and a differential pressure upon pressure drop of 1,500 to 3,000 kg/cm$^2$. The number of dispersing cycles may be selected as appropriate although it is usually 1 to 10. From the productivity standpoint, the number of dispersing cycles is 1 to about 3. It is not recommended from the standpoints of dispersibility and photographic properties to elevate the temperature of the water dispersion under high pressure. High temperatures above 90° C. tend to increase the particle size and the fog due to poor dispersion. Accordingly, in the preferred embodiment of the invention, a cooling step is provided prior to the conversion step and/or after the pressure drop step whereby the water dispersion is maintained at a temperature in the range of 5 to 90° C., more preferably 5 to 80° C. and most preferably 5 to 65° C. It is effective to use the cooling step particularly when dispersion is effected under a high pressure of 1,500 to 3,000 kg/cm$^2$. The cooling means used in the cooling step may be selected from various coolers, for example, double tube type heat exchangers, static mixer-built-in double tube type heat exchangers, multi-tube type heat exchangers, and serpentine heat exchangers, depending on the necessary quantity of heat exchange. For increasing the efficiency of heat exchange, the diameter, gage and material of the tube are selected as appropriate in consideration of the pressure applied thereto. Depending on the necessary quantity of heat exchange, the refrigerant used in the heat exchanger may be selected from well water at 20° C., cold water at 5 to 10° C. cooled by refrigerators, and if necessary, ethylene glycol/water at −30° C.

In the dispersing operation according to the invention, the organic silver salt is preferably dispersed in the presence of dispersants or dispersing agents soluble in an aqueous medium. The dispersing agents used herein include synthetic anionic polymers such as polyacrylic acid, acrylic acid copolymers, maleic acid copolymers, maleic acid monoester copolymers, and acryloylmethylpropanesulfonic acid copolymers; semi-synthetic anionic polymers such as carboxymethyl starch and carboxymethyl cellulose; anionic polymers such as alginic acid and pectic acid; the compounds described in JP-A 350753/1995; well-known anionic, nonionic and cationic surfactants; well-known polymers such as polyvinyl alcohol, polyvinyl pyrrolidone, carboxymethyl cellulose, hydroxypropyl cellulose and hydroxypropylmethyl cellulose; and naturally occurring polymers such as gelatin. Of these, polyvinyl alcohol and water-soluble cellulose derivatives are especially preferred.

In general, the dispersant is mixed with the organic silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The grain size (volume weighed mean diameter) of the solid particle dispersion of the organic silver salt obtained by the present invention may be determined by irradiating laser light, for example, to organic silver salt grains dispersed in liquid and determining the auto-correlation function of the fluctuation of scattering light relative to a time change. Preferably, the solid particle dispersion has a mean grain size of 0.05 $\mu$m to 10.0 $\mu$m, more preferably 0.1 $\mu$m to 5.0 $\mu$m, and most preferably 0.1 $\mu$m to 2.0 $\mu$m.

The grain size distribution of the organic silver salt is desirably monodisperse. Illustratively, the standard deviation of a volume weighed mean diameter divided by the volume weighed mean diameter, expressed in percent, which is a coefficient of variation, is preferably up to 80%, more preferably up to 50%, most preferably up to 30%.

The shape of the organic silver salt may be determined by observing a dispersion of the organic silver salt under a transmission electron microscope (TEM).

The dispersion liquid used herein is composed of at least the organic silver salt and water. The ratio of the organic silver salt to water is not critical although it is preferred that the organic silver salt accounts for 5 to 50% by weight, especially 10 to 30% by weight, of the entire system. It is preferred to use the dispersing agent as mentioned above and more preferably, in a minimum amount necessary to minimize the particle size. The dispersing agent is preferably used in an amount of 1 to 30% by weight, especially 3 to 15% by weight of the organic silver salt.

According to the invention, photothermographic elements can be prepared by mixing the water dispersion of the organic silver salt with a water dispersion of a photosensitive silver salt. The mixing ratio of organic silver salt to photosensitive silver salt is determined in accordance with a particular purpose. The proportion of the photosensitive silver salt is preferably 1 to 30 mol%, more preferably 3 to 20 mol% and most preferably 5 to 15 mol%, based on the moles of the organic silver salt. With respect to this mixing, a method of mixing two or more organic silver salt water dispersions with two or more photo-sensitive silver salt water dispersions is preferably employed for the purpose of adjusting photographic properties.

The organic silver salt is used in any desired amount, preferably about 0.1 to 5 g/m$^2$, more preferably about 1 to 3 g/m$^2$, as expressed by a silver coverage per square meter of the element.

Photosensitive Silver Halide

The silver halide emulsion has been formed independent of the organic silver salt. That is, the silver halide emulsion is a preformed one. Differently stated, the silver halide emulsion is not formed by partial halogen conversion of a non-photosensitive organic silver salt.

The halogen composition of the photosensitive silver halide used herein is not critical and may be any of silver chloride, silver chlorobromide, silver bromide, silver iodobromide, and silver iodochlorobromide. The halogen composition in grains may have a uniform distribution or a non-uniform distribution wherein the halogen concentration changes in a stepped or continuous manner. Silver halide grains of the core/shell structure are also useful. Such core/shell grains preferably have a multilayer structure of 2 to 5 layers, more preferably 2 to 4 layers. Silver chloride or silver chlorobromide grains having silver bromide localized at the surface thereof are also preferably used.

A method for forming the photosensitive silver halide according to the invention is well known in the art. Any of the methods disclosed in Research Disclosure No. 17029 (June 1978) and U.S. Pat. No. 3,700,458, for example, may be used. Specifically, use is made of a method of adding a silver-providing compound and a halogen-providing compound to a solution of gelatin or another polymer to form photo-sensitive silver halide grains and mixing the grains with an organic silver salt.

The photosensitive silver halide should preferably have a smaller grain size for the purpose of minimizing white turbidity after image formation. Specifically, the grain size is up to 0.20 $\mu$m, preferably 0.01 $\mu$m to 0.15 $\mu$m, most preferably 0.02 $\mu$m to 0.12 $\mu$m. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The photosensitive silver halide grains used herein may contain any of metals or metal complexes belonging to Groups VII and VIII (or Groups 7 to 10) in the Periodic Table. Preferred metals or central metals of metal complexes belonging to Groups VII and VIII in the Periodic Table are rhodium, rhenium, ruthenium, osmium, and iridium. The metal complexes may be used alone or in admixture of complexes of a common metal or different metals. The content of metal or metal complex is preferably $1\times10^{-9}$ mol to $1\times10^{-3}$ mol, more preferably $1\times10^{-8}$ mol to $1\times10^{-4}$ mol, per mol of silver. Illustrative metal complexes are those of the structures described in JP-A 225449/1995.

The rhodium compounds which can be used herein are water-soluble rhodium compounds, for example, rhodium (III) halides and rhodium complex salts having halogen, amine or oxalato ligands, such as hexachlororhodium(III) complex salt, pentachloroaquorhodium(III) complex salt, tetrachlorodiaquorhodium(III) complex salt, hexabromorhodium(III) complex salt, hexamminerhodium (III) complex salt, and trioxalatorhodium(III) complex salt. On use, these rhodium compounds are dissolved in water or suitable solvents. They are preferably added by a method commonly employed for stabilizing a solution of a rhodium compound, that is, a method of adding an aqueous solution of a hydrogen halide (e.g., hydrochloric acid, hydrobromic acid or hydrofluoric acid) or an alkali halide (e.g., KCl, NaCl, KBr or NaBr). Instead of using the water-soluble rhodium, it is possible to add, during preparation of silver halide, separate silver halide grains previously doped with rhodium, thereby dissolving rhodium.

An appropriate amount of the rhodium compound added is $1\times10^{-8}$ to $5\times10^{-6}$ mol, especially $5\times10^{-8}$ to $1\times10^{-6}$ mol, per mol of silver halide.

The rhodium compounds may be added at an appropriate stage during preparation of silver halide emulsion grains or prior to the coating of the emulsion. Preferably, the rhodium compound is added during formation of the emulsion so that the compound is incorporated into silver halide grains.

In the practice of the invention, rhenium, ruthenium and osmium are added in the form of water-soluble complex salts as described in JP-A 2042/1988, 285941/1989, 20852/1990 and 20855/1990. Especially preferred are hexacoordinate complexes represented by the formula:

$$[ML_6]^{n-}$$

wherein M is Ru, Re or Os, L is a ligand, and letter n is equal to 0, 1, 2, 3 or 4. The counter ion is not critical although it is usually an ammonium or alkali metal ion. Preferred ligands are halide ligands, cyanide ligands, cyanate ligands, nitrosil ligands, and thionitrosil ligands.

Illustrative, non-limiting, examples of the complex used herein are given below.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |

-continued

| | | |
|---|---|---|
| $[RuCl_6]^{3-}$ | $[RuCl_4(H_2O)_2]^{-}$ | $[RuCl_5(H_2O)]^{2-}$ |
| $[RuCl_5(NO)]^{2-}$ | $[RuBr_5(NS)]^{2-}$ | |
| $[Ru(CO)_3Cl3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(O)_2(CN)_4]^{4-}$ | |

An appropriate amount of these compounds added is $1\times10^{-9}$ to $1\times10^{-5}$ mol, especially $1\times10^{-8}$ to $1\times10^{-6}$ mol, per mol of silver halide.

These compounds may be added at an appropriate stage during preparation of silver halide emulsion grains or prior to the coating of the emulsion. Preferably, the compound is added during formation of the emulsion so that the compound is incorporated into silver halide grains.

In order that the compound be added during formation of silver halide grains so that the compound is incorporated into silver halide grains, there can be employed a method of adding a powder metal complex or an aqueous solution of a powder metal complex dissolved together with NaCl or KCl, to a water-soluble salt or water-soluble halide solution during formation of grains; a method of preparing silver halide grains by adding an aqueous solution of a metal complex as a third solution when silver salt and halide solutions are simultaneously mixed, thereby simultaneously mixing the three solutions; or a method of admitting a necessary amount of an aqueous solution of a metal complex into a reactor during formation of grains. Of these, the method of adding a powder metal complex or an aqueous solution of a powder metal complex dissolved together with NaCl or KCl to a water-soluble halide solution is especially preferred.

For addition to surfaces of grains, a necessary amount of an aqueous solution of a metal complex can be admitted into a reactor immediately after formation of grains, during or after physical ripening or during chemical ripening.

As the iridium compound, a variety of compounds may be used. Examples include hexachloroiridium, hexammineiridium, trioxalatoiridium, hexacyanoiridium, and pentachloronitrosiliridium. These iridium compounds are used as solutions in water or suitable solvents. They are preferably added by a method commonly employed for stabilizing a solution of an iridium compound, that is, a method of adding an aqueous solution of a hydrogen halide (e.g., hydrochloric acid, hydrobromic acid or hydrofluoric acid) or an alkali halide (e.g., KCl, NaCl, KBr or NaBr). Instead of using the water-soluble iridium, it is possible to add, during preparation of silver halide, separate silver halide grains previously doped with iridium, thereby dissolving iridium.

The silver halide grains used herein may contain metal atoms such as cobalt, iron, nickel, chromium, palladium, platinum, gold, thallium, copper, and lead. Preferred compounds of cobalt, iron, chromium and ruthenium are hexacyano metal complexes. Illustrative, non-limiting, examples include ferricyanate, ferrocyanate, hexacyanocobaltate, hexacyanochromate and hexacyanoruthenate ions. The distribution of the metal complex in silver halide grains is not critical. That is, the metal complex may be contained in silver halide grains uniformly or at a high concentration in either the core or the shell.

An appropriate amount of the metal added is $1\times10^{-9}$ to $1\times10^{-4}$ mol per mol of silver halide. The metal may be contained in silver halide grains by adding a metal salt in the form of a single salt, double salt or complex salt during preparation of grains.

Photosensitive silver halide grains may be desalted by any of well-known water washing methods such as noodle and flocculation methods although silver halide grains may be either desalted or not according to the invention.

When the silver halide emulsion according to the invention is subject to gold sensitization, there may be used any of gold sensitizers whose gold may have an oxidation number of +1 or +3. Conventional gold sensitizers are useful. Typical examples include chloroauric acid, potassium chloroaurate, auric trichloride, potassium auric thiocyanate, potassium iodoaurate, tetracyanoauric acid, ammonium aurothiocyanate, and pyridyl trichlorogold. The amount of the gold sensitizer added varies with various conditions although it is typically $1\times10^{-7}$ to $1\times10^{-3}$ mol. preferably $1\times10^{-6}$ to $5\times10^{-4}$ mol per mol of the silver halide.

The silver halide emulsion used herein should preferably be subject to gold sensitization and another chemical sensitization in combination. The chemical sensitization methods which can be used herein are sulfur, selenium, tellurium, and noble metal sensitization methods which are well known in the art. When they are used in combination with gold sensitization, preferred combinations are a combination of sulfur sensitization with gold sensitization, a combination of selenium sensitization with gold sensitization, a combination of sulfur sensitization and selenium sensitization with gold sensitization, a combination of sulfur sensitization and tellurium sensitization with gold sensitization, and a combination of sulfur sensitization, selenium sensitization, and tellurium sensitization with gold sensitization.

Sulfur sensitization that is preferably employed in the invention is generally carried out by adding a sulfur sensitizer to an emulsion and agitating the emulsion at an elevated temperature above 40° C. for a certain time. The sulfur sensitizers used herein are well-known sulfur compounds, for example, sulfur compounds contained in gelatin as well as various sulfur compounds such as thiosulfates, thioureas, thiazoles, and rhodanines. Preferred sulfur compounds are thiosulfate salts and thiourea compounds. The amount of the sulfur sensitizer added varies with chemical ripening conditions including pH, temperature and silver halide grain size although it is preferably $1\times10^{-7}$ to $1\times10^{-2}$ mol, more preferably $1\times10^{-5}$ to $1\times10^{-3}$ mol per mol of silver halide.

It is also useful to use selenium sensitizers which include well-known selenium compounds. Specifically, selenium sensitization is generally carried out by adding an unstable selenium compound and/or non-unstable selenium compound to an emulsion and agitating the emulsion at elevated temperature above 40° C. for a certain time. Preferred examples of the unstable selenium compound include those described in JP-B 15748/1969, JP-B 13489/1968, JP-A 25832/1992, JP-A 109240/1992 and JP-A 324855/1992. Especially preferred are the compounds represented by general formulae (VIII) and (IX) in JP-A 324855/1992.

The tellurium sensitizers are compounds capable of forming silver telluride, which is presumed to become sensitization nuclei, at the surface or in the interior of silver halide grains. The production rate of silver telluride in a silver halide emulsion can be determined by the test method described in JP-A 313284/1993. Exemplary tellurium sensitizers include diacyltellurides, bis(oxycarbonyl)tellurides, bis(carbamoyl)tellurides, bis(oxycarbonyl)ditellurides, bis (carbamoyl)ditellurides, compounds having a P═Te bond, tellurocarboxylic salts, Teorganyltellurocarboxylic esters, di(poly)tellurides, tellurides, telluroles, telluroacetals, tellurosulfonates, compounds having a P—Te bond, Te-containing heterocycles, tellurocarbonyl compounds, inorganic tellurium compounds, and colloidal tellurium.

Examples are described in U.S. Pat. Nos. 1,623,499, 3,320,069, 3,772,031, BP 235,211, 1,121,496, 1,295,462, 1,396,696, Canadian Patent No. 800,958, JP-A 204640/1992, Japanese Patent Application Nos. 53693/1991, 131598/1991, 129787/1992, J. Chem. Soc. Chem. Commun., 635 (1980), ibid., 1102 (1979), ibid., 645 (1979), J. Chem. Soc. Perkin. Trans., 1, 2191 (1980), S. Patai Ed., The Chemistry of Organic Selenium and Tellurium Compounds, Vol. 1 (1986), ibid., Vol. 2 (1987). Especially preferred are the compounds represented by general formulae (II), (III) and (IV) in JP-A 313284/1993.

The amounts of the selenium and tellurium sensitizers used vary with the type of silver halide grains, chemical ripening conditions and other factors although they are preferably about $1\times10^{-8}$ to $1\times10^{-2}$ mol, more preferably about $1\times10^{-7}$ to $1\times10^{-3}$ mol per mol of silver halide. The chemical sensitizing conditions are not particularly limited although preferred conditions include a pH of 5 to 8, a pAg of 6 to 11, more preferably 7 to 10, and a temperature of 40 to 95° C., more preferably 45 to 85° C.

In the preparation of the silver halide emulsion used herein, any of cadmium salts, sulfite salts, lead salts, and thallium salts may be co-present in the silver halide grain forming step or physical ripening step.

Reduction sensitization may also be used in the practice of the invention. Illustrative examples of the compound used in the reduction sensitization method include ascorbic acid, thiourea dioxide, stannous chloride, aminoiminomethanesulfinic acid, hydrazine derivatives, borane compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

To the silver halide emulsion according to the invention, thiosulfonic acid compounds may be added by the method described in EP-A 293,917.

The silver halide emulsion in the photothermographic element according to the invention may be a single emulsion or a mixture of two or more emulsions which are different in mean grain size, halogen composition, crystal habit or chemical sensitizing conditions.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding the preformed photosensitive silver halide at any timing during preparation of an organic silver salt. Any desired mixing method may be used insofar as the benefits of the invention are fully achievable.

Reducing Agent

The photothermographic element according to the preferred embodiment of the invention contains a reducing agent for the organic silver salt. The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 5 to 50 mol %, more preferably 10 to 40 mol % per mol of silver on the image forming layer-bearing side. The reducing agent may be added to any layer on the image forming layer-bearing side. Where the reducing agent is added to a layer other than the image forming layer, the reducing agent should preferably be contained in a slightly greater amount of about 10 to 50 mol % per mol of silver. The reducing agent may take the form of a precursor which is modified so as to exert its effective function only at the time of development.

For photothermographic elements using organic silver salts, a wide range of reducing agents are disclosed, for example, in JP-A 6074/1971, 1238/1972, 33621/1972, 46427/1974, 115540/1974, 14334/1975, 36110/1975, 147711/1975, 32632/1976, 1023721/1976, 32324/1976, 51933/1976, 84727/1977, 108654/1980, 146133/1981, 82828/1982, 82829/1982, 3793/1994, U.S. Pat. Nos. 3,667,958, 3,679,426, 3,751,252, 3,751,255, 3,761,270, 3,782,949, 3,839,048, 3,928,686, 5,464,738, German Patent No. 2321328, and EP 692732. Exemplary reducing agents include amidoximes such as phenylamidoxime, 2-thienylamidoxime, and p-phenoxyphenyl-amidoxime; azines such as 4-hydroxy-3,5-dimethoxybenzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzene-sulfonamidephenol; α-cyanophenyl acetic acid derivatives such as ethyl-α-cyano-2-methylphenyl acetate and ethyl-1-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols and chromanols.

The reducing agent may be added in any desired form such as solution, powder or solid particle dispersion. The solid particle dispersion of the reducing agent may be prepared by well-known comminuting means such as ball mills, vibrating ball mills, sand mills, colloidal mills, jet mills, and roller mills. Dispersing aids may be used for facilitating dispersion.

Toner

A higher optical density is sometimes achieved when an additive known as a "toner" for improving images is contained. The toner is also sometimes advantageous in forming black silver images. The toner is preferably used in an amount of 0.1 to 50 mol%, especially 0.5 to 20 mol% per mol of silver on the image forming layer-bearing side. The toner may take the form of a precursor which is modified so as to exert its effective function only at the time of development.

For photothermographic elements using organic silver salts, a wide range of toners are disclosed, for example, in JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 99813/1977, 1020/1978, 76020/1978, 156524/1979, 156525/1979, 183642/1986, and 56848/1992, JP-B 10727/1974 and 20333/1979, U.S. Pat. Nos. 3,080,254, 3,446,648, 3,782,941, 4,123,282, 4,510,236, BP 1,380,795, and Belgian Patent No. 841,910. Examples of the toner include phthalimide and N-hydroxyphthalimide; cyclic imides such as succinimide, pyrazolin-5-one, quinazolinone, 3-phenyl-2-pyrazolin-5-one, 1-phenylurazol, quinazoline and 2,4-thiazolidinedione; naphthalimides such as N-hydroxy-1,8-naphthalimide; cobalt complexes such as cobaltic hexammine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl) aryldicarboxyimides such as (N,N-dimethylaminomethyl) phthalimide and N,N-(dimethylaminomethyl)-naphthalene-2,3-dicarboxyimide; blocked pyrazoles, isothiuronium derivatives and certain photo-bleach agents such as N,N'-hexamethylenebis(1-carbamoyl-3,5-dimethylpyrazole), 1,8-(3,6-diazaoctane)bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(1-naphthyl) phthalazinone, 6-chlorophthalazinone, 5,7-dimethoxyphthalazinone and 2,3-dihydro-1,4-phthalazinedione; combinations of phthalazinones with phthalic acid derivatives (e.g., phthalic acid, 4-methylphthalic acid, 4-nitrophthalic acid and tetrachlorophthalic anhydride); phthalazine, phthalazine derivatives or metal salts such as 4-(1-naphthyl)phthalazine, 6-chlorophthalazine, 5,7-dimethoxyphthalazine, 6-isobutylphthalazine, 6-tert-butylphthalazine, 5,7-dimethylphthalazine, and 2,3-dihydro-phthalazine; combinations of phthalazine or derivatives thereof with phthalic acid derivatives (e.g., phthalic acid, 4-methylphthalic acid, 4-nitrophthalic acid and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

The toner may be added in any desired form, for example, as a solution, powder and solid particle dispersion. The solid particle dispersion of the toner is prepared by well-known finely dividing means such as ball mills, vibrating ball mills, sand mills, colloid mills, jet mills, and roller mills. Dispersing aids may be used in preparing the solid particle dispersion.

In the practice of the invention, a compound of the following formula (F) is preferably used as the toner.

Formula (F)

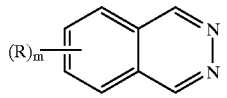

In formula (F), R is an alkyl group and m is an integer of 1 to 4. Preferred alkyl groups represented by R are those of 1 to 8 carbon atoms, more preferably 1 to 5 carbon atoms, for example, methyl, ethyl, n-propyl, isopropy, n-butyl, isobutyl, tert-butyl, tert-amyl and n-octyl. Where m≧2, a plurality of R's may be the same or different. of these combinations of alkyl groups, the combinations ensuring that the compounds have a melting point of not greater than 130° C. are preferably used herein. Some of these compounds are liquid at room temperature (about 15° C.).

Some illustrative, non-limiting examples of the compound of formula (F) having a melting point of not greater than 130° C. are given below.

A-1

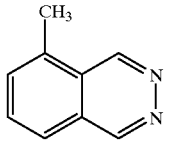

(mp 72–74° C.)

A-2

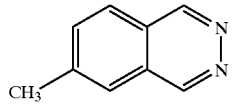

(mp 55° C.)

A-3

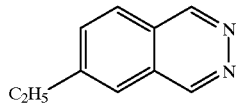

(mp 29–30° C.)

A-4

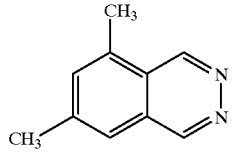

(mp 107–108° C.)

-continued

A-5

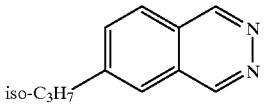

(mp 46–49° C.)

A-6

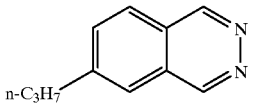

(liquid at room temperature)

A-7

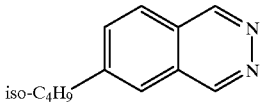

(mp 29–30° C.)

A-8

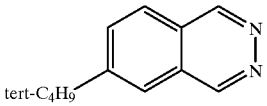

(mp 121–124° C.)

A-9

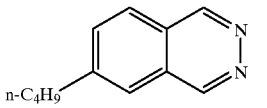

(liquid at room temperature)

A-10

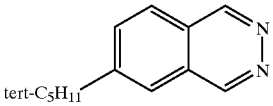

(mp 102–104° C.)

The compounds of formula (F) can be synthesized by well-known methods described, for example, in R. G. ElderField, "Heterocyclic Compounds," John Wiley and Sons, Vol. 1–9, 1950–1967 and A. R. Katritzky, "Comprehensive Heterocyclic Chemistry," Pergamon Press, 1984.

On the one surface of the support where the image forming layer is formed, the compound of formula (F) may be added to a photosensitive layer serving as the image forming layer or a non-photosensitive layer such as a protective layer.

The compound of formula (F) is preferably added in an amount of $10^{-4}$ to 1 mol/Ag, more preferably $10^{-3}$ to 0.3 mol/Ag, most preferably $10^{-3}$ to 0.1 mol/Ag, expressed in mol per mol of silver, although the amount varies with a particular purpose. The compounds of formula (F) may be used alone or in admixture of two or more.

The compound of formula (F) may be added in any desired form, for example, as a solution, powder and solid particle dispersion. The solid particle dispersion of the compound of formula (F) is prepared by well-known finely dividing means such as ball mills, vibrating ball mills, sand mills, colloid mills, jet mills, and roller mills. Dispersing aids may be used in preparing the solid particle dispersion.

Polymer Latex

At least one layer of the image forming layers used herein is an image forming layer wherein a polymer latex constitutes at least 50% by weight of the entire binder. This image forming layer is sometimes referred to as "inventive image forming layer" and the polymer latex used as the main binder therefor is referred to as "inventive polymer latex," hereinafter. Besides the image forming layer, the polymer latex may also be used in a protective layer or back layer. Particularly when the photothermographic element of the invention is used in a printing application where dimensional changes are a problem, it is necessary to use the polymer latex in the protective layer and back layer too. The "polymer latex" is a dispersion of a microparticulate water-insoluble hydrophobic polymer in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles should preferably have a mean particle size of about 1 to 50,000 nm, more preferably about 5 to 1,000 nm. No particular limit is imposed on the particle size distribution of dispersed particles, and the dispersion may have either a wide particle size distribution or a monodisperse particle size distribution.

The polymer latex used herein may be either a latex of the conventional uniform structure or a latex of the so-called core/shell type. In the latter case, better results are sometimes obtained when the core and the shell have different glass transition temperatures.

Polymers of polymer latexes used as the binder according to the invention have glass transition temperatures (Tg) whose preferred range differs among the protective layer, the back layer and the image-forming layer. For the image forming layer, polymers having a Tg of −30° C. to 40° C., especially 0° C. to 40° C. are preferred in order to promote the diffusion of photographically effective addenda upon heat development. For the protective layer and the back layer which are to come in contact with various equipment, polymers having a Tg of 25° C. to 70° C. are especially preferred.

The polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

Polymers used in the polymer latex according to the invention include acrylic resins, vinyl acetate resins, polyester resins, polyurethane resins, rubbery resins, vinyl chloride resins, vinylidene chloride resins, polyolefin resins, and copolymers thereof. The polymer may be linear, branched or crosslinked. The polymer may be either a homopolymer or a copolymer having two or more monomers polymerized together. The copolymer may be either a random copolymer or a block copolymer. The polymer preferably has a number average molecule weight Mn of about 5,000 to about 1,000,000, more preferably about 10,000 to about 100,000. Polymers with a too lower molecular weight would generally provide a low mechanical strength as the binder whereas polymers with a too higher molecular weight are difficult to form films.

Illustrative examples of the polymer latex which can be used as the binder in the image forming layer of the photothermographic element of the invention include latexes of methyl methacrylate/ethyl acrylate/methacrylic acid copolymers, latexes of methyl methacrylate/2-ethylhexyl acrylate/styrene/acrylic acid copolymers, latexes of styrene/butadiene/acrylic acid copolymers, latexes of styrene/butadiene/divinyl benzene/methacrylic acid copolymers, latexes of methyl methacrylate/vinyl chloride/acrylic acid copolymers, and latexes of vinylidene chloride/ethyl acrylate/acrylonitrile/methacrylic acid copolymers. These polymers or polymer latexes are commercially available. Exemplary acrylic resins are Sebian A-4635, 46583 and 4601 (Daicell Chemical Industry K.K.), Nipol LX811, 814, 820, 821, and 857 (Nippon Zeon K.K.), and Jurimer ET-410 and 530 (Nippon Junyaku K.K.). Exemplary polyester resins are FINETEX ES650, 611, 675, and 850 (DaiNippon Ink & Chemicals K.K.) and WD-size and WMS (Eastman Chemical Products, Inc.). Exemplary polyurethane resins are HYDRAN AP10, 20, 30 and 40 (DaiNippon Ink & Chemicals K.K.). Exemplary rubbery resins are LACSTAR 7310K, 3307B, 4700H, and 7132° C. (DaiNippon Ink & Chemicals K.K.) and Nipol LX410, 430, 435, and 438° C. (Nippon Zeon K.K.). Exemplary vinyl chloride resins are G351 and G576 (Nippon Zeon K.K.). Exemplary vinylidene chloride resins are L502 and L513 (Asahi Chemicals K.K.) and Aron D7020, D5040 and D5071 (Mitsui-Toatsu K.K.). Exemplary olefin resins are Chemipearl S120 and SA100 (Mitsui Chemical K.K.). These polymers may be used alone or in admixture of two or more.

In the inventive image forming layer, the above-described polymer latex is used in an amount of at least 50%, preferably at least 70% by weight of the entire binder.

In the inventive image forming layer, a hydrophilic polymer is added to the binder in an amount of up to 50% by weight of the entire binder, if desired. Such hydrophilic polymers are gelatin, polyvinyl alcohol, methyl cellulose, hydroxypropyl cellulose, carboxymethyl cellulose, and hydroxypropyl methyl cellulose. The amount of the hydrophilic polymer added is preferably less than 30%, more preferably less than 15% by weight of the entire binder in the image-forming layer.

In the practice of the invention, the image forming layer is preferably formed by applying an aqueous coating solution followed by drying. By the term "aqueous", it is meant that water accounts for at least 60% by weight of the solvent or dispersing medium of the coating solution. The component other than water of the coating solution may be a water-miscible organic solvent such as methyl alcohol, ethyl alcohol, isopropyl alcohol, methyl cellosolve, ethyl cellosolve, dimethylformamide, and ethyl acetate. Besides water, exemplary solvent compositions include a 90/10 mixture of water/methanol, a 70/30 mixture of water/methanol, a 90/10 mixture of water/ethanol, a 90/10 mixture of water/isopropanol, a 95/5 mixture of water/dimethylformamide, a 80/15/5 mixture of water/methanol/dimethylformamide, and a 90/5/5 mixture of water/methanol/dimethylformamide, all expressed in a weight ratio.

In the inventive image forming layer, the total amount of binder is preferably 0.2 to 30 g/m$^2$, more preferably 1.0 to 15 g/m$^2$. To the inventive image forming layer, crosslinking agents for crosslinking, surfactants for ease of application, and other addenda may be added.

Nucleating Agent

In order to produce high contrast images, the photothermographic element of the invention contains a nucleating agent in the image forming layer or another layer on the one surface of the support. According to the invention, compounds of formulae (A) and (B) are used as the nucleating agent.

Formula (A)

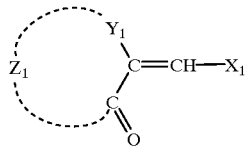

formula (B)

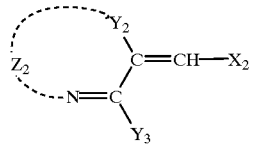

In formula (A), $Z_1$ is a group of non-metallic atoms completing a 5- to 7-membered cyclic structure, $Y_1$ is —C(=O)— or —$SO_2$—, $X_1$ is —.(1/k)M or —S.(1/k)M, M is a cation, and k is the valence of M.

In formula (B), $Z_2$ is a group of non-metallic atoms completing a 5- to 7-membered cyclic structure, $Y_2$ is —C(=O)— or —$SO_2$—, $X_2$ is —O.(1/k)M or —S.(1/k)M, M is a cation, k is the valence of M, and $Y_3$ is hydrogen or a substituent.

Formulae (A) and (B) are described in further detail.

In formula (A), $Z_1$ is a group of non-metallic atoms capable of forming a 5- to 7-membered cyclic structure with —$Y_1$—C(=CH—$X_1$)—C(=O)—. Preferably $Z_1$ is a group of atoms selected from among carbon, oxygen, sulfur, nitrogen and hydrogen atoms wherein several atoms selected these are coupled through valence bonds or double bonds to form a 5- to 7-membered cyclic structure with —$Y_1$—C(=CH—$X_1$)—C(=O)—. $Z_1$ may have a substituent or substituents. Also, $Z_1$ itself may be a part of an aromatic or non-aromatic carbocycle or a part of an aromatic or non-aromatic heterocycle, and in this case, the 5- to 7-membered cyclic structure that $Z_1$ forms with —$Y_1$—C(=CH—$X_1$)—C(=O)— forms a fused ring structure.

In formula (B), $Z_2$ is a group of non-metallic atoms capable of forming a 5- to 7-membered cyclic structure with —$Y_2$—C(=CH—$X_2$)—C($Y_3$)=N—. Preferably $Z_2$ is a group of atoms selected from among carbon, oxygen, sulfur, nitrogen and hydrogen atoms wherein several atoms selected these are coupled through valence bonds or double bonds to form a 5- to 7-membered cyclic structure with —$Y_2$—C(=CH—$X_2$)—C($Y_3$)=N—. $Z_2$ may have a substituent or substituents. Also, $Z_2$ itself may be a part of an aromatic or non-aromatic carbocycle or a part of an aromatic or non-aromatic heterocycle, and in this case, the 5- to 7-membered cyclic structure that $Z_2$ forms with —$Y_2$—C(=CH—$X_2$)—C($Y_3$)=N— forms a fused ring structure.

When $Z_1$ and $Z_2$ have substituents, exemplary substituents include halogen atoms (e.g., fluorine, chlorine, bromine and iodine), alkyl groups (including aralkyl, cycloalkyl, and active methine groups), alkenyl groups, alkynyl groups, aryl groups, heterocyclic groups, heterocyclic groups containing a quaternized nitrogen atom (e.g., pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (inclusive of groups having recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy)carbonylamino groups, sulfamoylamino groups, semicarbazide groups, thiosemicarbazide groups, hydrazino groups, quaternary ammonio groups, oxamoylamino groups, (alkyl or aryl) sulfonylureido groups, acylureido groups, acylsulfamoylamino groups, nitro groups, mercapto groups, (alkyl, aryl or heterocyclic) thio groups, (alkyl or aryl)sulfonyl groups, (alkyl or aryl)sulfinyl groups, sulfo groups or salts thereof, sulfamoyl groups, acylsulfamoyl groups, sulfonylsulfamoyl groups or salts thereof, groups containing a phosphoramide or phosphate structure, silyl groups, and stannyl groups. These substituents may be further substituted with such substituents.

In formula (B), $Y_3$ is hydrogen or a substituent. Exemplary substituents represented by $Y_3$ include alkyl, aryl, heterocyclic, cyano, acyl, alkoxycarbonyl, aryloxycarbonyl, carbamoyl, amino, (alkyl, aryl or heterocyclic) amino, acylamino, sulfonamide, ureido, thioureido, imide, aikoxy, aryloxy, (alkyl, aryl or heterocyclic) thio groups. These groups represented by $Y_3$ may have any substituents, examples of which are the above-exemplified substituents that $Z_1$ or $Z_2$ may have.

In formulae (A) and (B), $X_1$ and $X_2$ each are —O.(1/k)M or —S.(1/k)M wherein M is a cation and k is the valence of M. Exemplary cations include alkali metal ions (e.g., sodium ion, potassium ion, and lithium ion), alkaline earth metal ions (e.g., magnesium ion and calcium ion), silver ion, zinc ion, quaternary ammonium ions (e.g., tetraethylammonium ion, tetrabutylammonium ion, and dimethylcetylbenzylammonium ion), and quaternary phosphonium ion. Letter k is preferably equal to 1 or 2.

In formulae (A) and (B), $Y_1$ and $Y_2$ each are —C(=O)— or —$SO_2$—.

Of the compounds of formulae (A) and (B), the following compounds are preferred.

In formulae (A) and (B), $Y_1$ and $Y_2$ each are preferably —C(=O)—.

In formulae (A) and (B), $X_1$ and $X_2$ each are preferably —OM wherein M is preferably a sodium ion, potassium ion, magnesium ion, silver ion, zinc ion or quaternary ammonium ion. M is especially a sodium ion or potassium ion.

In formula (A), $Z_1$ is preferably a group of atoms capable of forming a 5— or 6-membered cyclic structure. Illustratively, $Z_1$ is a group of atoms selected from among nitrogen, carbon, sulfur and oxygen atoms, for example, —N—N—, —N—C—, —O—C—, —C—C—, —C=C—, —S—C—, —C=C—N—, —C=C—O—, —N—C—N—, —N=C—N—, —C—C—C—, —C=C—C—, and —O—C—O—, which further have hydrogen atoms or substituents. More preferably, $Z_1$ is a group of atoms such as —N—N—, —N—C—, —O—C—, —C—C—, —C=C—, —S—C—, —N—C—N—, or —C=C—N—, which further have hydrogen atoms or substituents. Most preferably, $Z_1$ is a group of atoms such as —N—N—, —N—C—, —O—C—, or —C=C—, which further have hydrogen atoms or substituents.

Also preferably, $Z_1$ itself is a part of an aromatic or non-aromatic carbocycle or an aromatic or non-aromatic heterocycle, and forms a fused ring structure to the 5- to 7-membered cyclic structure that $Z_1$ forms with —$Y_1$—C(=CH—$X_1$)—C(=O)—. Examples of the aromatic or non-aromatic carbocycle or the aromatic or non-aromatic heterocycle include benzene, naphthalene, pyridine, cyclohexane, piperidine, pyrazolidine, pyrrolidine, 1,2-piperazine, 1,4-piperazine, oxan, oxolane, thian, and thiolane rings. These carbocycles and heterocycles may further have a ring fused thereto, and such a fused ring may be a cyclic ketone. Of the carbocycles and heterocycles forming a fused ring structure, benzene, piperidine, and 1,2-piperazine rings are preferred, with the benzene ring being most preferred.

In formula (B), $Z_2$ is preferably a group of atoms capable of forming a 5— or 6-membered cyclic structure. Illustratively, $Z_2$ is a group of atoms selected from among nitrogen, carbon, sulfur and oxygen atoms, for example, —N—, —O—, —S—, —C—, —C=C—, —C—C—, —N—C—, —N=C—, —O—C—, and —S—C—, which further have hydrogen atoms or substituents if possible.

Also preferably, $Z_2$ itself is a part of an aromatic or non-aromatic carbocycle or an aromatic or non-aromatic heterocycle, and forms a fused ring structure to the 5- to 7-membered cyclic structure that $Z_2$ forms with —$Y_2$—C(=CH—$X_2$)—C($Y_3$)=N—. Examples of the aromatic or non-aromatic carbocycle or the aromatic or non-aromatic heterocycle include benzene, naphthalene, pyridine, cyclohexane, piperidine, pyrazolidine, pyrrolidine, 1,2-piperazine, 1,4-piperazine, oxan, oxolane, thian, and thiolane rings.

More preferably in formula (B), $Z_2$ is such a group of atoms as —N—, —O—, —S—, —C—, or —C=C—, which further have hydrogen atoms or substituents if possible, and especially such a group of atoms as —N— or —O—, which further have hydrogen atoms or substituents if possible.

In formulae (A) and (B), exemplary substituents that $Z_1$ or $Z_2$ have include alkyl, aryl, halogen, heterocyclic, acyl, alkoxycarbonyl, aryloxycarbonyl, carbamoyl, carboxy (or salt thereof), sulfonylcarbamoyl, cyano, hydroxy, acyloxy, alkoxy, amino, (alkyl, aryl or heterocyclic) amino, acylamino, sulfonamide, ureido, thioureido, imide, (alkoxy or aryloxy) carbonylamino, sulfamoylamino, nitro, mercapto, (alkyl, aryl or heterocyclic) thio, (alkyl or aryl) sulfonyl, sulfo (or salt thereof), and sulfamoyl groups.

Where $Z_1$ or $Z_2$ itself becomes a part of an aromatic or non-aromatic carbocycle or an aromatic or non-aromatic heterocycle to form a fused ring structure, the aromatic or non-aromatic carbocycle or aromatic or non-aromatic heterocycle may have a substituent or substituents, which are preferably selected from the same groups as described just above.

$Y_3$ in formula (B) is preferably hydrogen or one of the following substituents: alkyl, aryl (especially phenyl and naphthyl), heterocyclic, cyano, acyl, alkoxycarbonyl, carbamoyl, (alkyl, aryl or heterocyclic) amino, acylamino, sulfonamide, ureido, imide, alkoxy, aryloxy, (alkyl, aryl or heterocyclic) thio groups.

More preferably, $Y_3$ in formula (B) is a substituent. Illustrative substituents are: alkyl, phenyl, amino, anilino, acylamino, alkoxy, aryloxy, and carbamoyl groups. These substituents may further have substituents although the total number of carbon atoms is preferably 1 to 25, more preferably 1 to 18.

Preferably, the compounds of formula (A) have at least 6 carbon atoms in total, and the compounds of formula (B) have at least 12 carbon atoms in total. No upper limit is imposed on the total number of carbon atoms although the total number of carbon atoms in the compounds of formula (A) is preferably up to 40, more preferably up to 30 and the total number of carbon atoms in the compounds of formula (B) is preferably up to 40, more preferably up to 30.

In formula (A), the total number of carbon atoms included in $Z_1$, inclusive of its substituents, is preferably at least 2, more preferably at least 3. In formula (B), the total number of carbon atoms included in $Z_2$ and $Y_3$, inclusive of their substituents, is preferably at least 8. In formula (A), the total number of carbon atoms included in $Z_1$, inclusive of its substituents, is more preferably from 3 to 40, most preferably from 6 to 30. In formula (B), the total number of carbon atoms included in $Z_2$ and $Y_3$, inclusive of their substituents, is more preferably from 8 to 40, most preferably from 8 to 30.

Of the compounds of formulae (A) and (B), especially preferred are those compounds of formula (A) wherein $Y_1$ is a carbonyl group, and $Z_1$ forms an indanedione, pyrrolidinedione, pyrazolidinedione, or oxolanedione ring with —$Y_1$—C(═CH—$X_1$)—C(═O)—. Those compounds of formula (A) wherein $Z_1$ forms a pyrazolidinedione ring are most preferred.

The compounds of formulae (A) and (B) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

The compounds of formulae (A) and (B) may have incorporated therein a ballast group or polymer commonly used in immobile photographic additives such as couplers. The compounds of formulae (A) and (B) having a ballast group incorporated therein are preferred. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

The compounds of formulae (A) and (B) may contain a cationic group (e.g., a group containing a quaternary ammonio group and a nitrogenous heterocyclic group containing a quaternized nitrogen atom), a group containing recurring ethylenoxy or propylenoxy units, an (alkyl, aryl or heterocyclic) thio group, or a group which is dissociable with a base (e.g., carboxy, sulfo, acylsulfamoyl, and carbamoylsulfamoyl). The compounds of formulae (A) and (B) bearing a group containing recurring ethylenoxy or propylenoxy units or an (alkyl, aryl or heterocyclic) thio group are preferred. Exemplary such groups are described in, for example, in JP-A 234471/1995, 333466/1993, 19032/1994, 19031/1994, 45761/1993, 259240/1991, 5610/1995, and 244348/1995, U.S. Pat. Nos. 4,994,365 and 4,988,604, and German Patent No. 4006032.

Illustrative, non-limiting examples of the compounds of formulae (A) and (B) are given below.

1

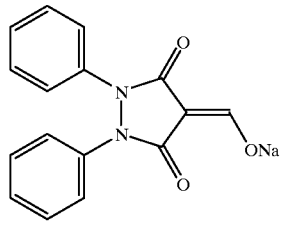

2

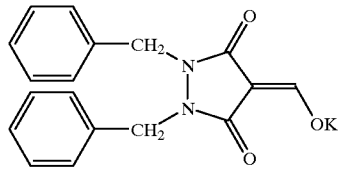

3

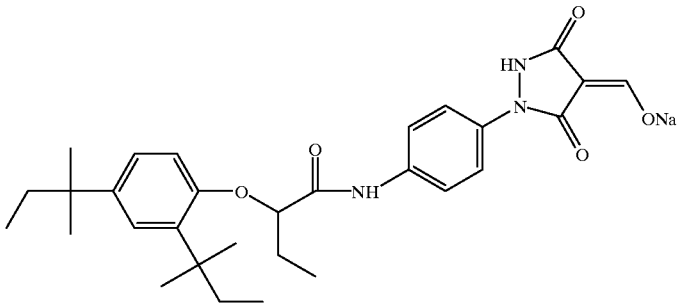

-continued
4
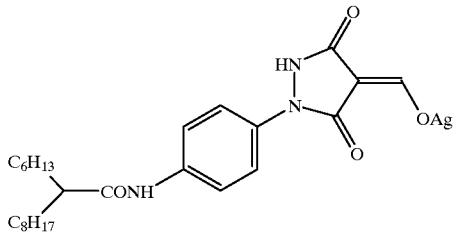
5
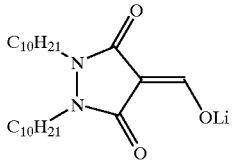
6
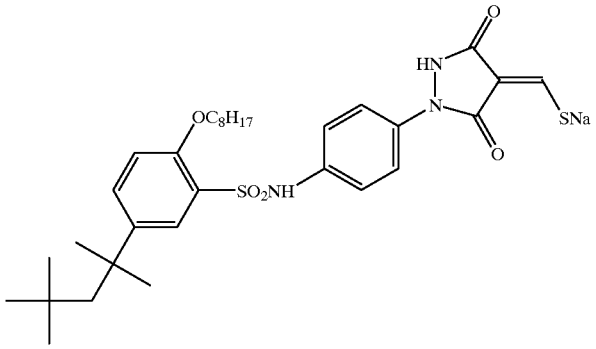
7
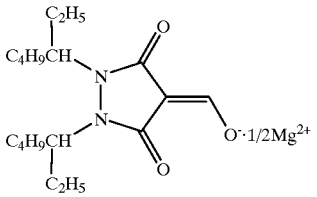
8
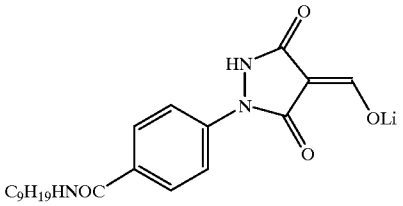
9
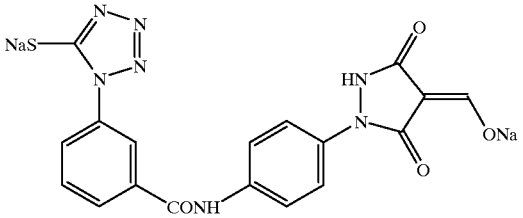

-continued
10
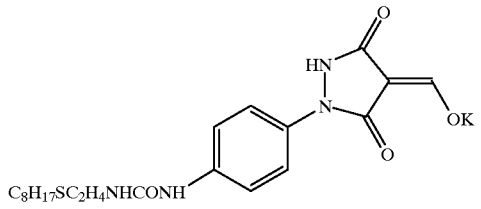
11
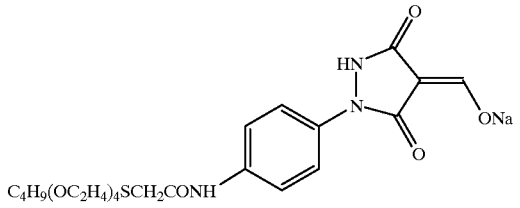
12
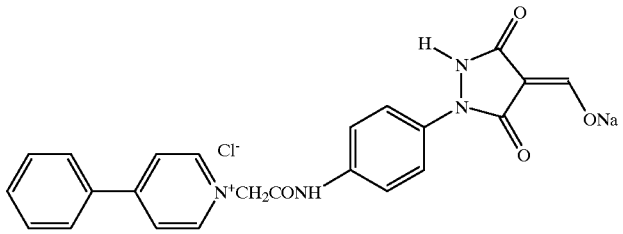
13
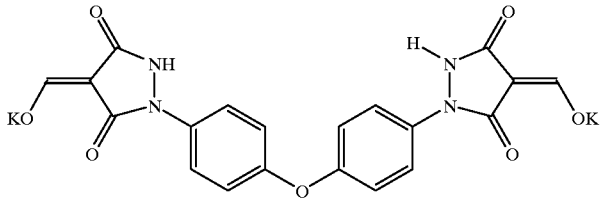
14
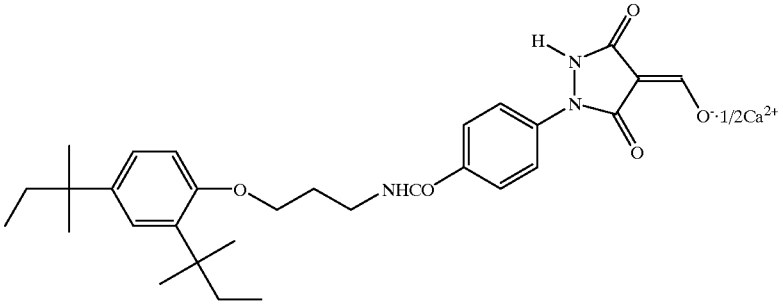
15
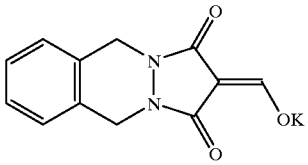
16
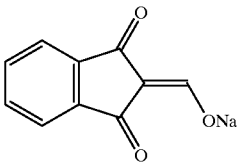

-continued
17
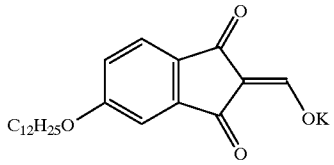
18
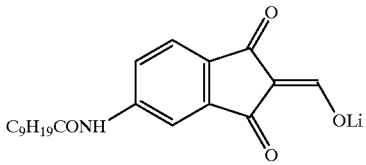
19
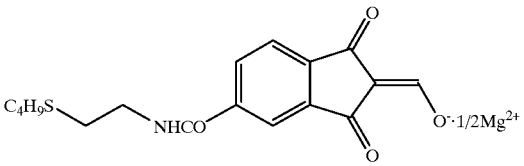
20
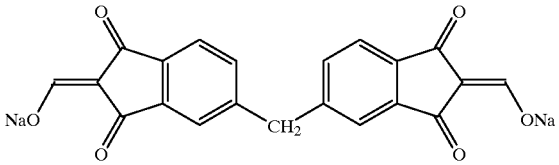
21
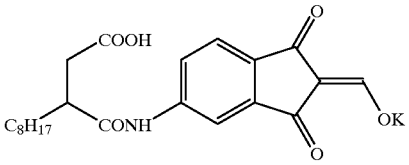
22
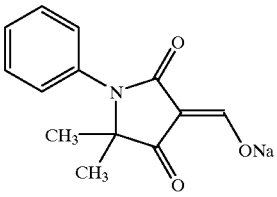
23
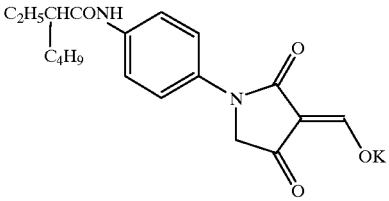
24
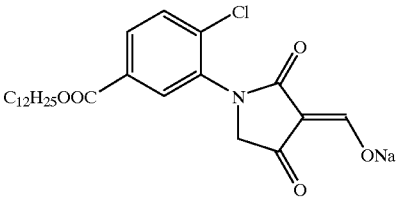

-continued
25
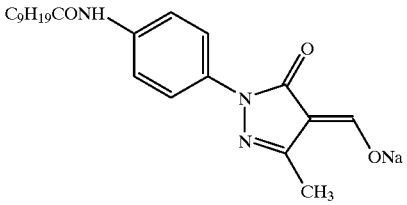
26
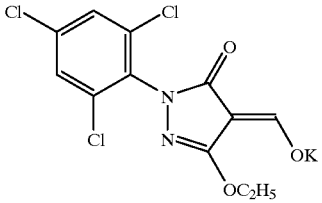
27
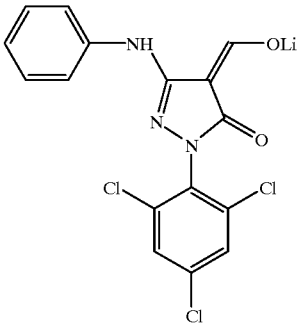
28
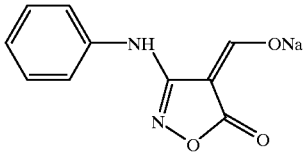
29
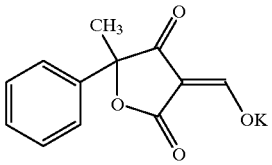
30
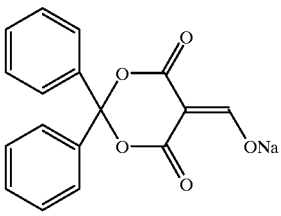
31
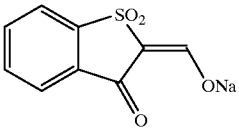

-continued
32
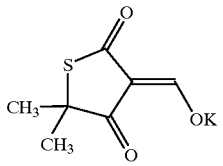
33
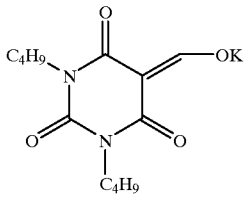
34
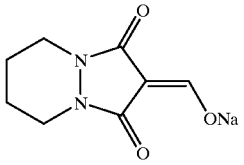
35
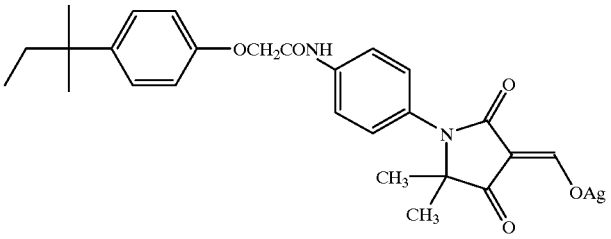
36
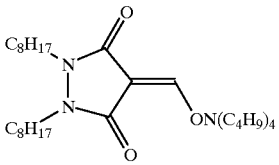
37
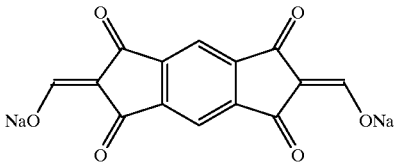
38
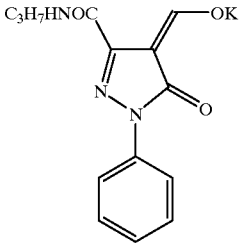

-continued

39

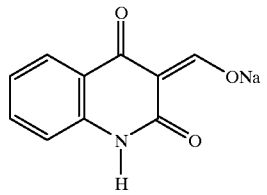

40

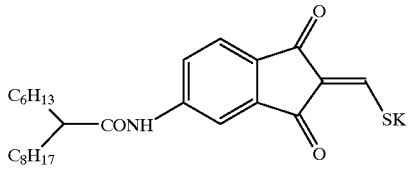

41

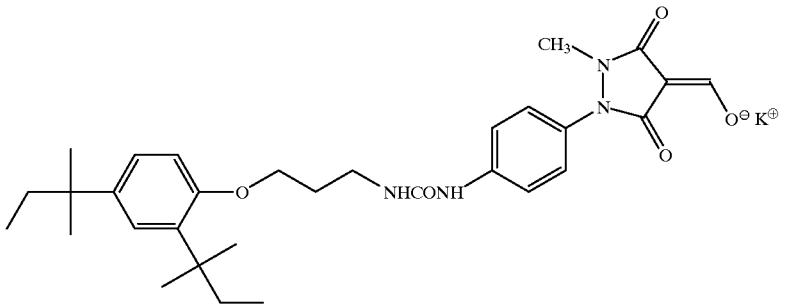

42

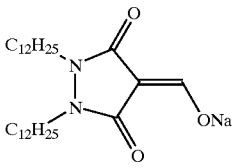

43

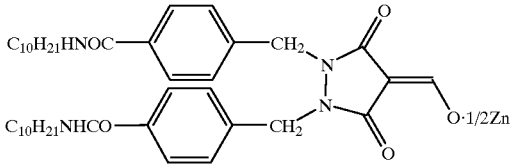

The compounds of formulae (A) and (B) are added to a coating solution as a water dispersion. The solvent used herein is most preferably water alone although alcohols such as methanol, ethanol, propanol and fluorinated alcohols may be contained in an amount of up to 30% by volume, preferably up to 10% by volume. Surfactants may be added for solubilizing the compounds of formulae (A) and (B) although it is recommended in the practice of the invention not to add surfactants because many surfactants can adversely affect photographic properties. Since the compounds of formulae (A) and (B) are amphiphatic, they can form micelle in water and be solubilized without surfactants. In such micelle formation, the amount of the compound of formula (A) or (B) added to an aqueous solvent is typically about 0.1 to about 20 g per 100 g of the aqueous solvent while the amount of surfactant is 0 to about 200% by weight of the compound. The surfactant which can be used herein is any of nonionic, anionic, cationic and fluorochemical surfactants. Examples include fluorinated polymer surfactants as described in JP-A 170950/1987 and U.S. Pat. No. 5,380,644, fluorochemical surfactants as described in JP-A 244945/1985 and 188135/1988, polysiloxane surfactants as described in U.S. Pat. No. 3,885,965, and polyalkylene oxide and anionic surfactants as described in JP-A 301140/1994.

A well-known emulsifying dispersion method may be used for dissolving the compound of formula (A) or (B) in water with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. The emulsified dispersion can be used as a water dispersion. Alternatively, a method known as a solid dispersion method is used for dispersing the compound of formula (A) or (B) in powder form in a suitable solvent, typically water, in a ball mill, colloidal mill or ultrasonic mixer. The resulting solid dispersion can be used as a water dispersion. In forming the emulsified dispersion or solid dispersion, the compounds of formulae (A) and (B), which are amphiphatic, can be dispersed as microparticulates with the aid of very small amounts of surfactants or even without surfactants. The amount of surfactant used is 0 to about 200% by weight of the compound. When the compounds of formulae (A) and (B) are used as a solid dispersion, dispersed particles preferably have a mean particle size of 0.1 to 2 $\mu$m, and at least 80% by weight of the dispersed particles fall in the particle size range of 0.3 to 1 $\mu$m.

In the practice of the invention, the compounds of formulae (A) and (B) are preferably added as a micelle dispersion or solid dispersion, especially micelle dispersion.

The compounds of formulae (A) and (B) may be added to any layer on the image forming layer-bearing side of the support, that is, the image forming layer or another layer on one surface of the support, and preferably to the image forming layer or a layer disposed adjacent thereto.

The compounds of formulae (A) and (B) is preferably used in an amount of $1\times10^{-6}$ mol to 1 mol, more preferably $1\times10^{-5}$ mol to $5\times10^{-1}$ mol, and most preferably $2\times10^{-5}$ mol to $2\times10^{-1}$ mol per mol of silver.

The compounds of formulae (A) and (B) can be readily synthesized by well-known methods, for example, the methods described in U.S. Pat. Nos. 5,545,515, 5,635,339, 5,654,130, WO 97/34196, Japanese Patent Application Nos. 309813/1997 and 272002/1997.

The compounds of formulae (A) and (B) may be used alone or in admixture of two or more. In combination with the compounds of formulae (A) and (B), there may be used any of the compounds described in U.S. Pat. Nos. 5,545,515, 5,635,339, 5,654,130, 5,686,228, WO 97/34196, Japanese Patent Application Nos. 279962/1996, 228881/1997, 272002/1997, 272003/1997, 273935/1997, 282564/1997, 296174/1997, 309813/1997, and 332388/1997.

Development Accelerator

In the practice of the invention, hydrazine derivatives of the following formula (H) are preferably used as a development accelerator.

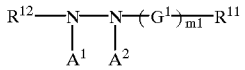

(H)

In formula (H), $R^{12}$ is an aliphatic, aromatic or heterocyclic group. $R^{11}$ is hydrogen or a block group. $G^1$ is —CO—, —COCO—, —C(=S)—, —$SO_2$—, —SO—, —PO($R^{13}$)— or iminomethylene group. $R^{13}$ is selected from the same groups as defined for $R^{11}$ and may be different from $R^{11}$. Both $A^1$ and $A^2$ are hydrogen, or one of $A^1$ and $A^2$ is hydrogen and the other is a substituted or unsubstituted alkylsulfonyl, substituted or unsubstituted arylsulfonyl or substituted or unsubstituted acyl group. Letter ml is equal to 0 or 1. $R^{11}$ is an aliphatic, aromatic or heterocyclic group when ml is 0.

In formula (H), the aliphatic groups represented by $R^{12}$ are preferably substituted or unsubstituted, normal, branched or cyclic alkyl, alkenyl and alkynyl groups having 1 to 30 carbon atoms.

In formula (H), the aromatic groups represented by $R^{12}$ are preferably monocyclic or fused ring aryl groups, for example, phenyl and naphthyl groups derived from benzene and naphthalene rings. The heterocyclic groups represented by $R^{12}$ are preferably monocyclic or fused ring, saturated or unsaturated, aromatic or non-aromatic heterocyclic groups while the heterocycles in these groups include pyridine, pyrimidine, imidazole, pyrazole, quinoline, isoquinoline, benzimidazole, thiazole, benzothiazole, piperidine, triazine, morpholine, and piperazine rings.

Aryl, alkyl and aromatic heterocyclic groups are most preferred as $R^{12}$.

The groups represented by $R^{12}$ may have substituents. Exemplary substituents include halogen atoms (e.g., fluorine, chlorine, bromine and iodine), alkyl groups (inclusive of aralkyl, cycloalkyl and active methine groups), alkenyl groups, alkynyl groups, aryl groups, heterocyclic groups, heterocyclic groups containing a quaternized nitrogen atom (e.g., pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (inclusive of groups having recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy)carbonylamino groups, sulfamoylamino groups, semicarbazide groups, thiosemicarbazide groups, hydrazino groups, quaternary ammonio groups, oxamoylamino groups, (alkyl or aryl)sulfonylureido groups, acylureido groups, acylsulfamoylamino groups, nitro groups, mercapto groups, (alkyl, aryl or heterocyclic) thio groups, (alkyl or aryl)sulfonyl groups, (alkyl or aryl)sulfinyl groups, sulfo groups or salts thereof, sulfamoyl groups, acylsulfamoyl groups, sulfonylsulfamoyl groups or salts thereof, and groups containing a phosphoramide or phosphate structure. These substituents may be further substituted with such substituents.

Preferred substituents that $R^{12}$ may have include, where $R^{12}$ is an aromatic or heterocyclic group, alkyl (inclusive of active methylene), aralkyl, heterocyclic, substituted amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

Where $R^{12}$ is an aliphatic group, preferred substituents include alkyl, aryl, heterocyclic, amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

In formula (H), $R^{11}$ is hydrogen or a block group. Illustrative of the block group are aliphatic groups (e.g., alkyl, alkenyl and alkynyl groups), aromatic groups (monocyclic or fused ring aryl groups), heterocyclic groups, alkoxy, aryloxy, amino and hydrazino groups.

The alkyl groups represented by $R^{11}$ are preferably substituted or unsubstituted alkyl groups having 1 to 10 carbon atoms, for example, methyl, ethyl, trifluoromethyl, difluoromethyl, 2-carboxytetrafluoroethyl, pyridiniomethyl, difluoromethoxymethyl, difluorocarboxymethyl, 3-hydroxypropyl, hydroxymethyl, 3-methanesulfonamidopropyl, benzenesulfonamidomethyl, trifluoroacetylmethyl, dimethylaminomethyl, phenylsulfonylmethyl, o-hydroxybenzyl, methoxymethyl, phenoxymethyl, 4-ethylphenoxymethyl, phenylthiomethyl, t-butyl, dicyanomethyl, diphenylmethyl, triphenylmethyl, methoxycarbonyldiphenylmethyl, cyanodiphenylmethyl, and methylthiodiphenylmethyl groups. The alkenyl groups are preferably those having 1 to 10 carbon atoms, for example, vinyl, 2-ethoxycarbonylvinyl, 2-trifluoro-2-methoxycarbonylvinyl, 2,2-dicyanovinyl, and 2-cyano-2-methoxycarbonylvinyl groups. The alkynyl groups are preferably those having 1 to 10 carbon atoms, for example, ethynyl and 2-methoxycarbonylethynyl groups. The aryl groups are preferably monocyclic or fused ring aryl groups, especially those containing a benzene ring, for example, phenyl, perfluorophenyl, 3,5-dichlorophenyl, 2-methanesulfonamidophenyl, 2-carbamoylphenyl, 4,5-dicyanophenyl, 2-hydroxymethylphenyl, 2,6-dichloro-4-cyanophenyl, and 2-chloro-5-octylsulfamoylphenyl groups.

The heterocyclic groups represented by $R^{11}$ are preferably 5- and 6-membered, saturated or unsaturated, monocyclic or fused ring, heterocyclic groups containing at least one of nitrogen, oxygen and sulfur atoms, for example, morpholino, piperidino (N-substituted), imidazolyl, indazolyl (e.g., 4-nitroindazolyl), pyrazolyl, triazolyl, benzimidazolyl, tetrazolyl, pyridyl, pyridinio (e.g., N-methyl-3-pyridinio), quinolinio, quinolyl, hydantoyl, and imidazolidinyl groups.

The alkoxy groups are preferably those having 1 to 8 carbon atoms, for example, methoxy, 2-hydroxyethoxy, benzyloxy, and t-butoxy groups. The aryloxy groups are preferably substituted or unsubstituted phenoxy groups. The amino groups are preferably unsubstituted amino, alkylamino having 1 to 10 carbon atoms, arylamino, and saturated or unsaturated heterocyclic amino groups (inclusive of nitrogenous heterocyclic amino groups containing a quaternized nitrogen atom). Examples of the amino group include 2,2,6,6-tetramethylpiperidin-4-ylamino, propylamino, 2-hydroxyethylamino, anilino, o-hydroxyanilino, 5-benzotriazolylamino, and N-benzyl-3-pyridinioamino groups. The hydrazino groups are preferably substituted or unsubstituted hydrazino groups and substituted or unsubstituted phenylhydrazino groups (e.g., 4-benzenesulfonamidophenylhydrazino).

The groups represented by $R^{11}$ may be substituted ones, with examples of the substituent being as exemplified for the substituent on $R^{12}$.

In formula (H), $R^{11}$ may be such a group as to induce cyclization reaction to cleave a $G^1$—$R^{11}$ moiety from the remaining molecule to generate a cyclic structure containing the atoms of the —$G^1$—$R^{11}$ moiety. Such examples are described in JP-A 29751/1988, for example.

The hydrazine derivative of formula (H) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

$R^{11}$ and $R^{12}$ in formula (H) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

$R^{11}$ or $R^{12}$ in formula (H) may have a plurality of hydrazino groups as substituents. In this case, the compounds of formula (H) are polymeric with respect to hydrazino groups. Exemplary polymeric compounds are described in JP-A 86134/1989, 16938/1992, 197091/1993, WO 95-32452 and 95-32453, Japanese Patent Application Nos. 351132/1995, 351269/1995, 351168/1995, 351287/1995, and 351279/1995.

$R^{11}$ or $R^{12}$ in formula (H) may contain a cationic group (e.g., a group containing a quaternary ammonio group and a nitrogenous heterocyclic group containing a quaternized nitrogen atom), a group containing recurring ethylenoxy or propylenoxy units, an (alkyl, aryl or heterocyclic) thio group, or a group which is dissociable with a base (e.g., carboxy, sulfo, acylsulfamoyl, and carbamoylsulfamoyl). Exemplary compounds containing such a group are described in, for example, in JP-A 234471/1995, 333466/1993, 19032/1994, 19031/1994, 45761/1993, 259240/1991, 5610/1995, and 244348/1995, U.S. Pat. Nos. 4,994,365 and 4,988,604, and German Patent No. 4006032.

In formula (H), each of $A^1$ and $A^2$ is a hydrogen atom, a substituted or unsubstituted alkyl- or arylsulfonyl group having up to 20 carbon atoms (preferably a phenylsulfonyl group or a phenylsulfonyl group substituted such that the sum of Hammett substituent constants may be −0.5 or more), or a substituted or unsubstituted acyl group having up to 20 carbon atoms (preferably a benzoyl group, a benzoyl group substituted such that the sum of Hammett substituent constants may be −0.5 or more, or a linear, branched or cyclic, substituted or unsubstituted, aliphatic acyl group wherein the substituent is selected from a halogen atom, ether group, sulfonamide group, carbonamide group, hydroxyl group, carboxy group and sulfo group). Most preferably, both $A^1$ and $A^2$ are hydrogen atoms.

The preferable range of the hydrazine derivatives of the general formula (H) is described.

In formula (H), $R^{12}$ is preferably phenyl, alkyl of 1 to 3 carbon atoms or aromatic heterocyclic groups.

Where $R^{12}$ represents phenyl or aromatic heterocyclic groups, preferred substituents thereon include nitro, cyano, alkoxy, alkyl, acylamino, ureido, sulfonamide, thioureido, carbamoyl, sulfamoyl, sulfonyl, carboxy (or salts thereof), sulfo (or salts thereof), alkoxycarbonyl, and chloro groups.

Where $R^{12}$ represents substituted alkyl groups of 1 to 3 carbon atoms, it is more preferably substituted methyl groups, and further preferably di— or tri-substituted methyl groups. Exemplary preferred substituents on these methyl groups include methyl, phenyl, cyano, (alkyl, aryl or heterocyclic) thio, alkoxy, aryloxy, chloro, heterocyclic, alkoxycarbonyl, aryloxycarbonyl, carbamoyl, sulfamoyl, amino, acylamino, and sulfonamide groups, and especially, substituted or unsubstituted phenyl groups.

Where $R^1$ represents substituted methyl groups, preferred examples thereof are t-butyl, dicyanomethyl, dicyanophenylmethyl, triphenylmethyl (trityl), diphenylmethyl, methoxycarbonyldiphenylmethyl, cyanodiphenylmethyl, methylthiodiphenylmethyl, cyclopropyldiphenylmethyl groups, with trityl being most preferred.

Where $R^{12}$ represents aromatic heterocyclic groups, it is preferred that the heterocycles in $R^{12}$ be pyridine, quinoline, pyrimidine, triazine, benzothiazole, benzimidazole, and thiophene rings.

Most preferably, $R^{12}$ in formula (H) represents substituted or unsubstituted phenyl groups.

In formula (H), m1 is equal to 0 or 1. When m1 is 0, $R^{11}$ represents aliphatic, aromatic or heterocyclic groups. When m1 is 0, $R^{11}$ more preferably represents phenyl groups, substituted alkyl groups of 1 to 3 carbon atoms or alkenyl groups. Of these groups, the phenyl groups and substituted alkyl groups of 1 to 3 carbon atoms are the same as the preferred range of $R^{12}$ mentioned above. When $R^{11}$ represents alkenyl groups, preferred $R^{11}$ groups are vinyl groups, especially vinyl groups having one or two substituents selected from the group consisting of cyano, acyl, alkoxycarbonyl, nitro, trifluoromethyl, and carbamoyl. Exemplary are 2,2-dicyanovinyl, 2-cyano-2-methoxycarbonylvinyl, and 2-acetyl-2-ethoxycarbonylvinyl.

Preferably m1 is equal to 1.

Where $R^{12}$ is a phenyl or aromatic heterocyclic group and $G^1$ is —CO—, the groups represented by $R^{11}$ are preferably selected from hydrogen, alkyl, alkenyl, alkynyl, aryl and heterocyclic groups, more preferably from hydrogen, alkyl and aryl groups, and most preferably from hydrogen atoms and alkyl groups. Where $R^{11}$ represents alkyl groups, preferred substituents thereon are halogen, alkoxy, aryloxy, alkylthio, arylthio, hydroxy, sulfonamide, amino, acylamino, and carboxy groups.

Where $R^{12}$ is a substituted methyl group and $G^1$ is —CO—, the groups represented by $R^{11}$ are preferably selected from hydrogen, alkyl, aryl, heterocyclic, alkoxy, and amino groups (including unsubstituted amino, alkylamino, arylamino and heterocyclic amino groups), more preferably from hydrogen, alkyl, aryl, heterocyclic, alkoxy, alkylamino, arylamio and heterocyclic amino groups. Where $G^1$ is —COCO—, independent of $R^{12}$, $R^{11}$ is preferably selected from alkoxy, aryloxy, and amino groups, more preferably from substituted amino groups, specifically alkylamino, arylamino and saturated or unsaturated heterocyclic amino groups.

Where $G^1$ is —$SO_2$—, independent of $R^{12}$, $R^{11}$ is preferably selected from alkyl, aryl and substituted amino groups.

In formula (H), $G^1$ is preferably —CO— or —COCO—, and most preferably —CO—.

Illustrative, non-limiting, examples of the compound represented by formula (H) are given below.

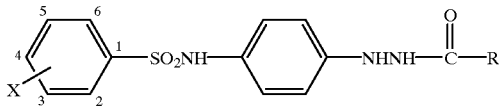

| | X = | R = —H | —$C_2F_4$—COOH or (—$C_2F_4$—$COO^{\ominus}K^{\oplus}$) | 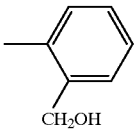 | 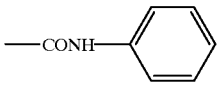 |
|---|---|---|---|---|---|
| 1 | 3-NHCO—$C_9H_{19}$(n) | 1a | 1b | 1c | 1d |
| 2 | 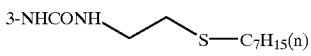 | 2a | 2b | 2c | 2d |
| 3 | 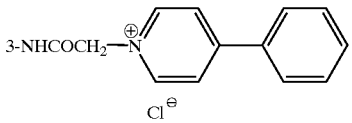 | 3a | 3b | 3c | 3d |
| 4 | 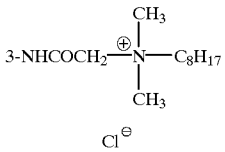 | 4a | 4b | 4c | 4d |
| 5 | 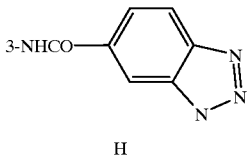 | 5a | 5b | 5c | 5d |
| 6 | 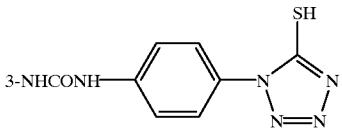 | 6a | 6b | 6c | 6d |

-continued
| 7 | 2,4-$(CH_3)_2$-3-$SC_2H_4$—$(OC_2H_4)_4$—$OC_8H_{17}$ | 7a | 7b | 7c | 7d |
|---|---|---|---|---|---|
| | 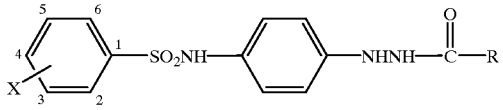 | | | | |
| | | R = | | | |
| | X = | —H | —$CF_2H$ | 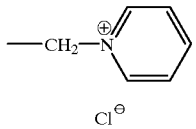 | 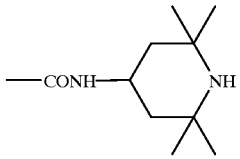 |
| 8 | 3-$CONHCH_2CH(C_2H_5)$—$C_4H_9$ | 8a | 8e | 8f | 8g |
| 9 | 6-$OCH_3$-3-$C_5H_{11}$(t) | 9a | 9e | 9f | 9g |
| 10 | 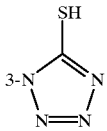 | 10a | 10e | 10f | 10g |
| 11 | 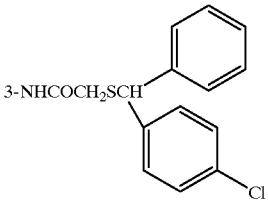 | 11a | 11e | 11f | 11g |
| 12 | 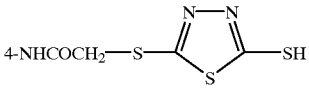 | 12a | 12e | 12f | 12g |
| 13 | 3-$NHCOCH(CH_2COOH)$—$C_8H_{17}$ | 13a | 13e | 13f | 13g |
| 14 | 3,5—$(CONHCH_2CH(C_2H_5)$—$C_4H_9)_2$ | 14a | 14e | 14f | 14g |

-continued
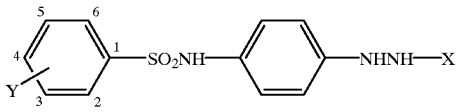
| | Y = | X = —CHO | —$COCF_3$ | —$SO_2CH_3$ | —$P(=O)(OC_2H_5)_2$ |
|---|---|---|---|---|---|
| 15 | 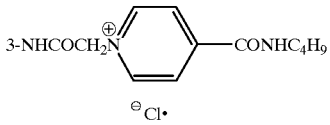 | 15a | 15h | 15i | 15j |
| 16 | 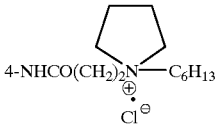 | 16a | 16h | 16i | 16j |
| 17 | 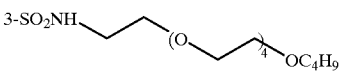 | 17a | 17h | 17i | 17j |
| 18 | 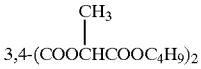 | 18a | 18h | 18i | 18j |
| 19 | 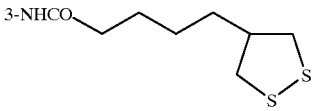 | 19a | 19h | 19i | 19j |
| 20 | 3-$NHSO_2NH$—$C_8H_{17}$ | 20a | 20h | 20i | 20j |
| 21 | 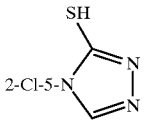 | 21a | 21h | 21i | 21j |
| | | R = —H | —$CF_3$ | 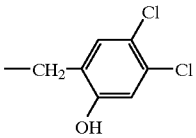 | 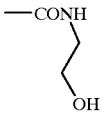 |
|---|---|---|---|---|---|
| 22 | 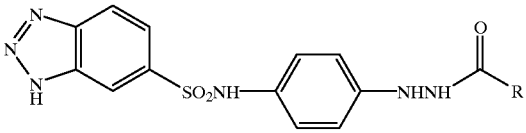 | 22a | 22h | 22k | 22l |

-continued
| | | | | | |
|---|---|---|---|---|---|
| 23 | 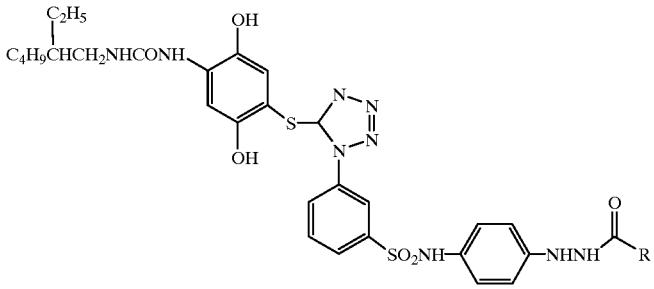 | 23a | 23h | 23k | 23l |
| 24 | 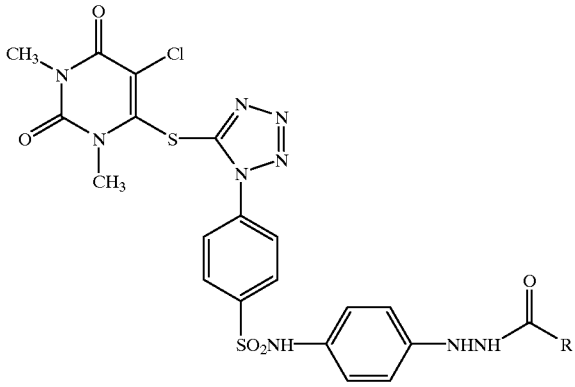 | 24a | 24h | 24k | 24l |
| 25 | 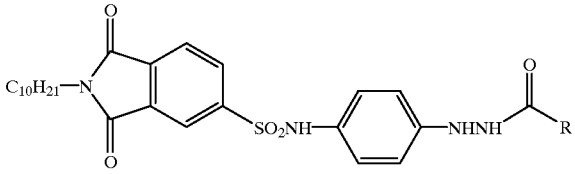 | 25a | 25h | 25k | 25l |
| 26 | 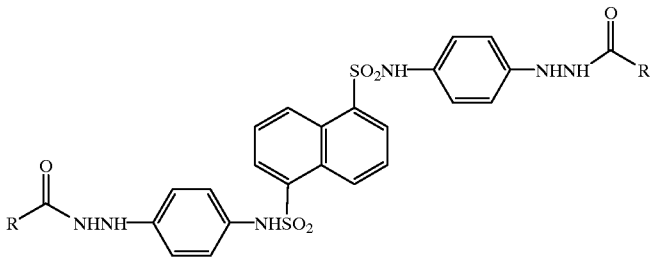 | 26a | 26h | 26k | 26l |
| 27 | 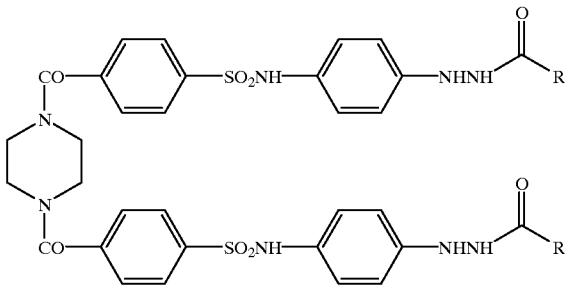 | 27a | 27h | 27k | 27l |

-continued
| | | | | | |
|---|---|---|---|---|---|
| 28 | 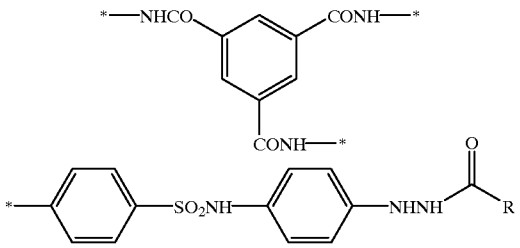 | 28a | 28h | 28k | 28l |
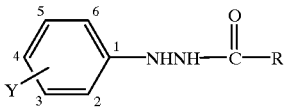
| | Y = | R = —H | —$CH_2OCH_3$ | 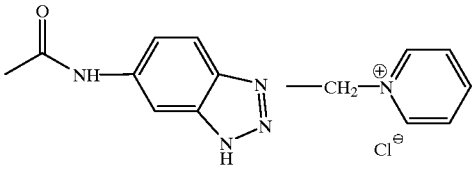 | |
|---|---|---|---|---|---|
| 29 | 4-NHC(=S)NH—$C_8H_{17}$(n) | 29a | 29m | 29n | 29f |
| 30 | 4-NHP(=O)(O $CH_2$—)$_2$ | 30a | 30m | 30n | 30f |
| 31 | 4-NHCONH—$(CH_2)_3O$— | 31a | 31m | 31n | 31f |
| 32 | 4-OH, 3-NHCONHCH($C_2H_5$)$CH_2$CH—$C_4H_9$ | 32a | 32m | 32n | 32f |
| 33 | 4-$NHSO_2(CH_2)_2NHCO$— | 33a | 33m | 33n | 33f |
| 34 | 4-$OCH_2$— | 34a | 34m | 34n | 34f |
| 35 | 4-NHCONH—N($CH_2$—)$_2$ | 35a | 35m | 35n | 35f |

-continued
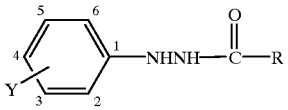
| | Y = | R = —H | —$CF_2SCH_3$ | —$CONHCH_3$ | 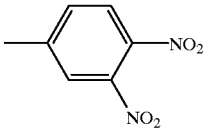 |
|---|---|---|---|---|---|
| 36 | 2-$NHSO_2CH_3$— 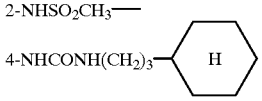 | 36a | 36o | 36p | 36q |
| 37 | 2-$OCH_3$— 4-$NHSO_2C_{12}H_{25}$ | 37a | 37o | 37p | 37q |
| 38 | 3-$NHCOC_{11}H_{23}$— 4-$NHSO_2CF_3$ | 38a | 38o | 38p | 38q |
| 39 | 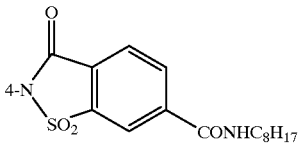 | 39a | 39o | 39p | 39q |
| 40 | 4-$OCO(CH_2)_2COOC_6H_{13}$ | 40a | 40o | 40p | 40q |
| 41 | 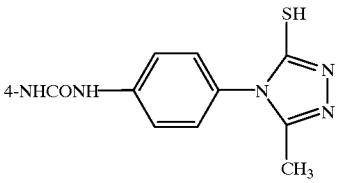 | 41a | 41o | 41p | 41q |
| 42 | 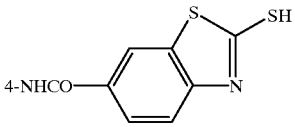 | 42a | 42o | 42p | 42q |
43
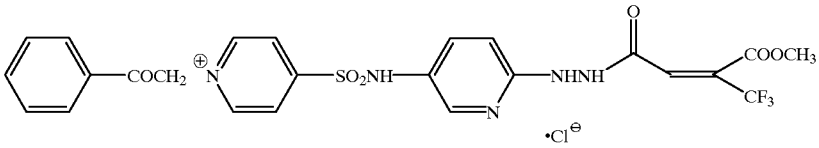
44
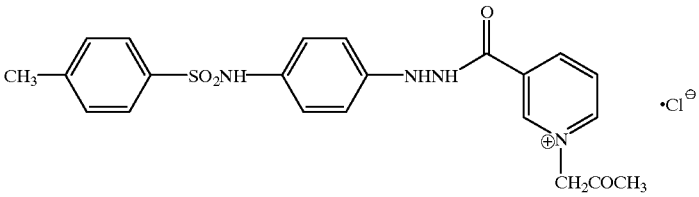

-continued
45
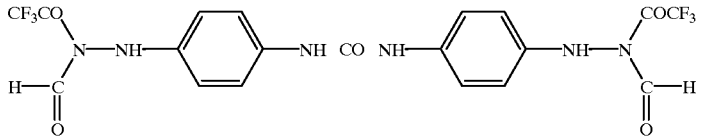
46
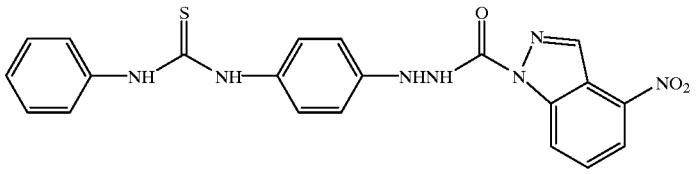
47
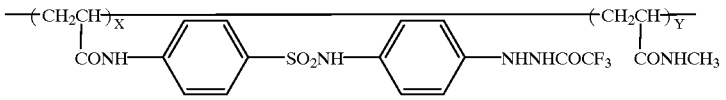
X:Y = 3.97
average molecular weigt~100,000
48
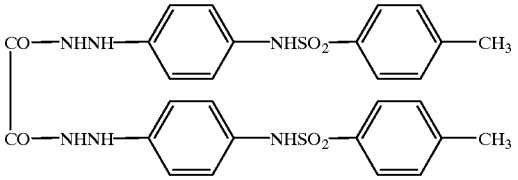
49
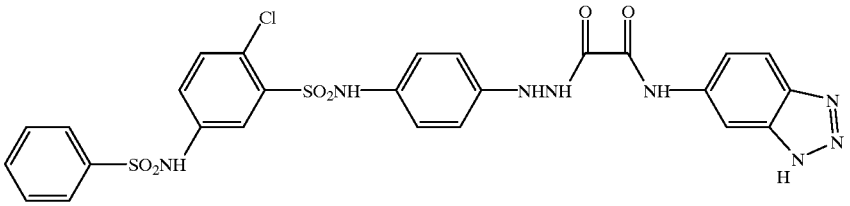
50
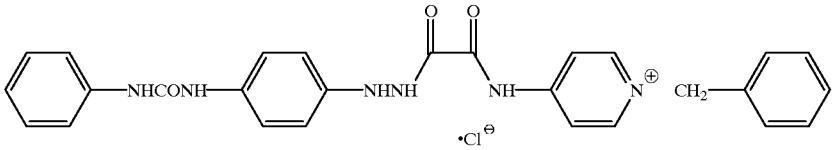
51
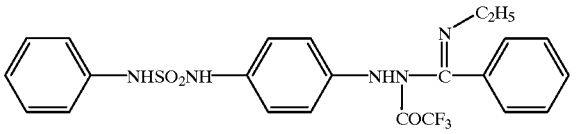
52
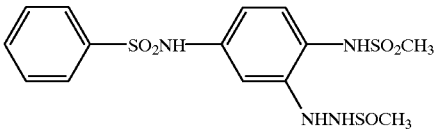
53
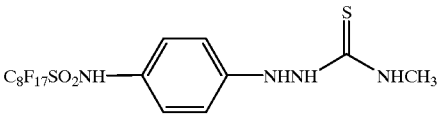

-continued
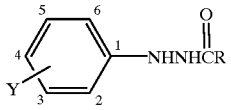
| | Y = | R = —H | —$CH_2OCH_3$ | —$CH_2O$— 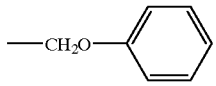 | —$CONHC_3H_7$ |
|---|---|---|---|---|---|
| 54 | 2-$OCH_3$ | 54a | 54m | 54r | 54s |
| 55 | 2-$OCH_3$ 5-$C_8H_{17}$(t) | 55a | 55m | 55r | 55s |
| 56 | 4-$NO_2$ | 56a | 56m | 56r | 56s |
| 57 | 4-$CH_3$ | 57a | 57m | 57r | 57s |
| 58 | 4-NHCO— 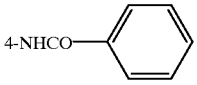 | 58a | 58m | 58r | 58s |
| 59 | 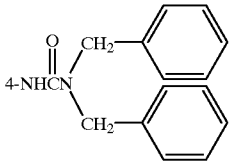 | 59a | 59m | 59r | 59s |
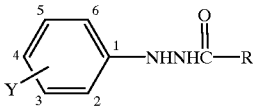
| | Y = | R = —H | 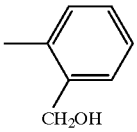 | —$CH_2$—N⊕ 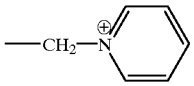 •$Cl^{\ominus}$ | —CONH— 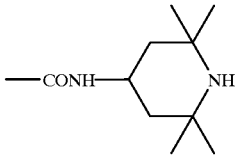 |
|---|---|---|---|---|---|
| 60 | 2-$OCH_3$ 5-$OCH_3$ | 60a | 60c | 60f | 60g |
| 61 | 4-$C_8H_{17}$(t) | 61a | 61c | 61f | 61g |
| 62 | 4-$OCH_3$ | 62a | 62c | 62f | 62g |
| 63 | 3-$NO_2$ | 63a | 63c | 63f | 63g |
| 64 | 4-NHCO— 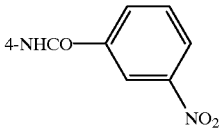 | 64a | 64c | 65f | 64g |
| 65 | 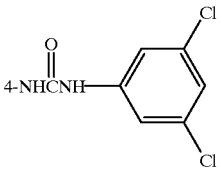 | 65a | 65c | 65f | 65g |

-continued
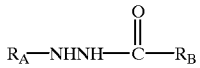
| | $R_A$ = | $R_B$ = —H | —$CH_2O$— 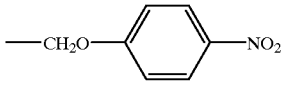 —$NO_2$ | — 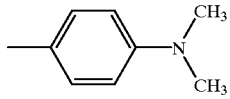 —N($CH_3$)$_2$ | —NH— 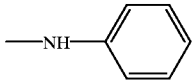 |
|---|---|---|---|---|---|
| 66 | 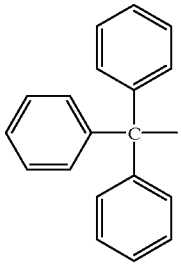 | 66a | 66u | 66v | 66t |
| 67 | 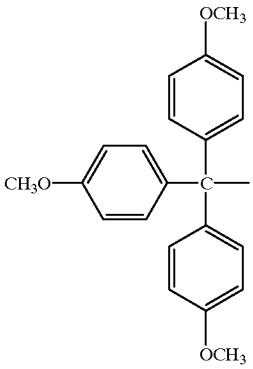 | 67a | 67u | 67v | 67t |
| 68 | 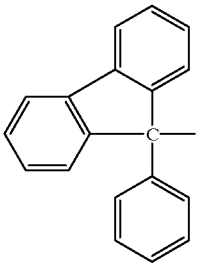 | 68a | 68u | 68v | 68t |
| 69 | 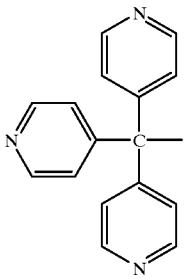 | 69a | 69u | 69v | 69t |

-continued
| | | | | | |
|---|---|---|---|---|---|
| 70 | 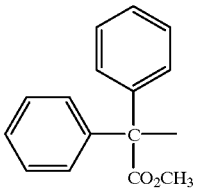 | 70a | 70u | 70v | 70t |
| 71 | 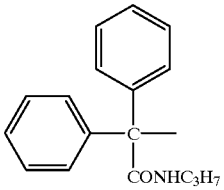 | 71a | 71u | 71v | 71t |
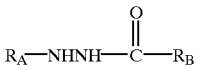
| | $R_B$ = | | | |
|---|---|---|---|---|
| $R_A$ = | 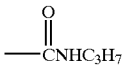 | 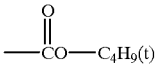 | 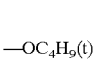 | 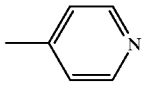 |
| 72 | 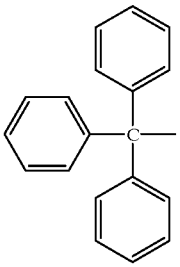 | 72s | 72x | 72y | 72w |
| 73 | 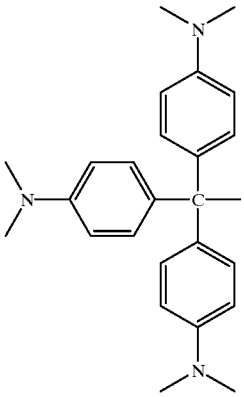 | 73s | 73x | 73y | 73w |

-continued
| | | | | | |
|---|---|---|---|---|---|
| 74 | 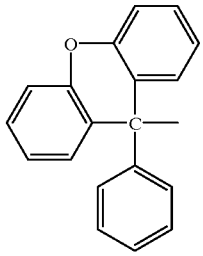 | 74s | 74x | 74y | 74w |
| 75 | 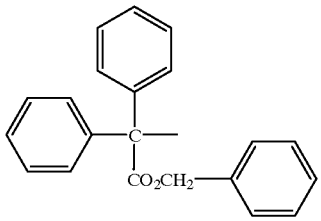 | 75s | 75x | 75y | 75w |
| 76 | 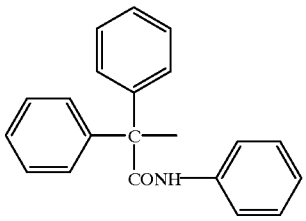 | 76s | 76x | 76y | 76w |
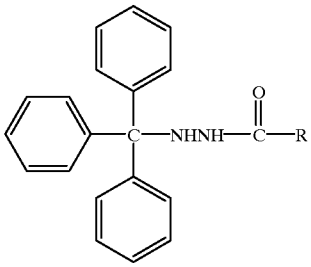
R =
| | |
|---|---|
| 77 | 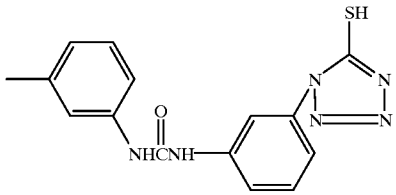 |
| 78 | 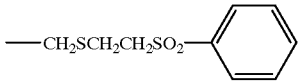 |
| 79 | —$CH_2OCH_2CH_2SCH_2CH_2OCH_3$ |
| 80 | —$CF_2CF_2COOH$ |
| 81 | 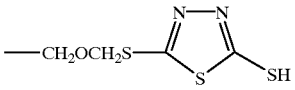 |

-continued
82
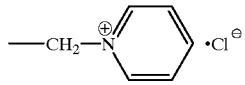
83
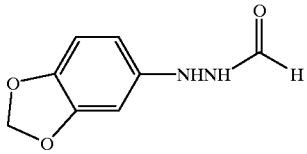
84
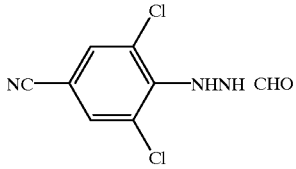
85
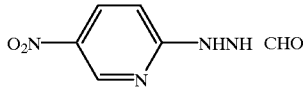
86
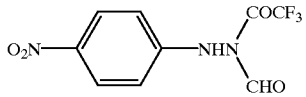
87
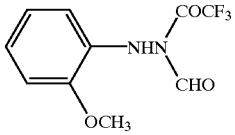
88
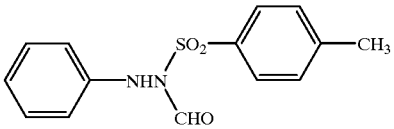
89
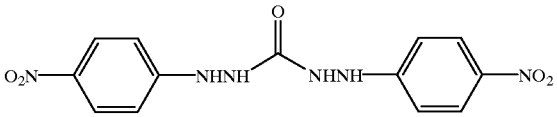
90
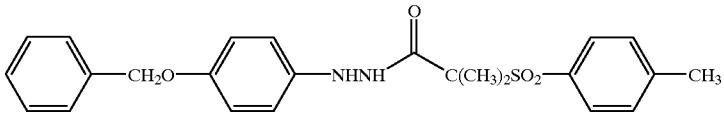
91
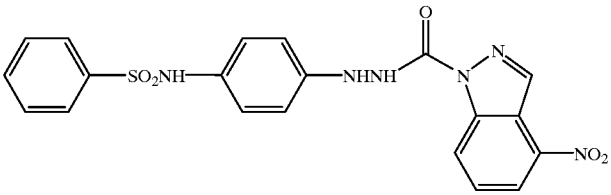

-continued
| | |
|---|---|
| 92 | 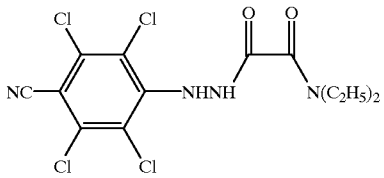 |
| 93 | 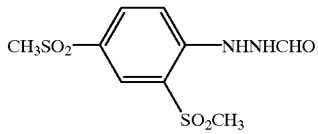 |
| 94 | 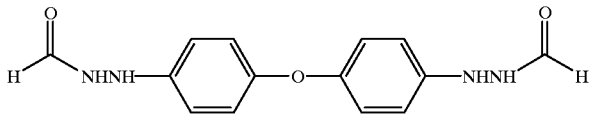 |
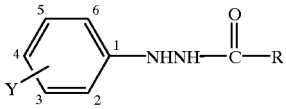
| | | R = | | | |
|---|---|---|---|---|---|
| | Y = | 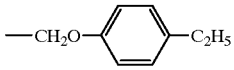 | 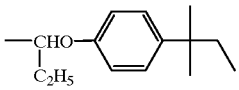 | 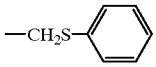 | $-CH_2-Cl$ |
| 95 | 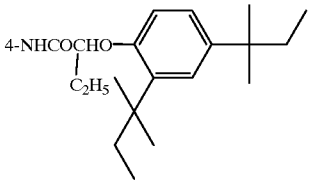 | 95-1 | 95-2 | 95-3 | 95-4 |
| 96 | 4-COOH | 96-1 | 96-2 | 96-3 | 96-4 |
| 97 | 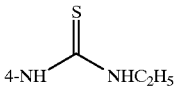 | 97-1 | 97-2 | 97-3 | 97-4 |
| 98 | 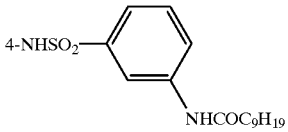 | 98-1 | 98-2 | 98-3 | 98-4 |
| 99 | 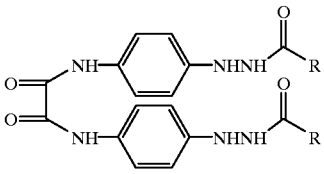 | 99-1 | 99-2 | 99-3 | 99-4 |
| 100 | 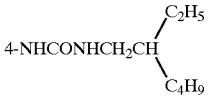 | 100-1 | 100-2 | 100-3 | 100-4 |

-continued
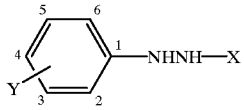
| | Y = | X = 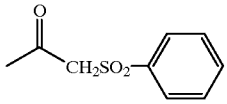 | 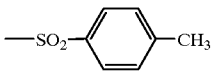 | 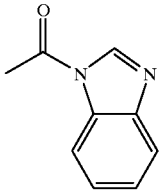 | 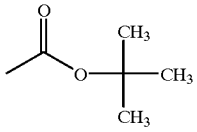 |
|---|---|---|---|---|---|
| 101 | 4-$NO_2$ | 101-5 | 101-6 | 101-7 | 101-y |
| 102 | 2,4-$OCH_3$ | 102-5 | 102-6 | 102-7 | 102-y |
| 103 | 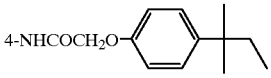 | 103-5 | 103-6 | 103-7 | 103-y |
| | Y = | X = 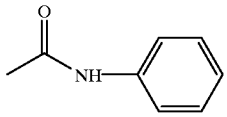 | 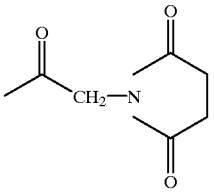 | 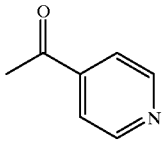 | 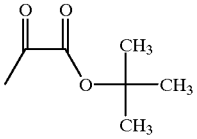 |
|---|---|---|---|---|---|
| 104 | 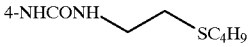 | 104-8 | 104-9 | 104w' | 104x |
| 105 | 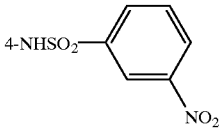 | 105-8 | 105-9 | 105w' | 105x |
Y—NHNH—X
| | Y = | X = 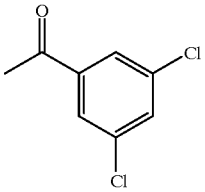 | 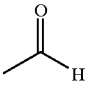 | 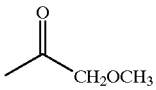 | 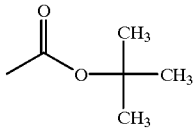 |
|---|---|---|---|---|---|
| 106 | 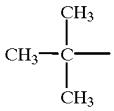 | 106-10 | 106a | 106m | 106y |

-continued
| | | | | | |
|---|---|---|---|---|---|
| 107 | 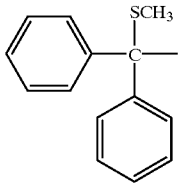 | 107-10 | 107a | 107m | 107y |
| 108 | 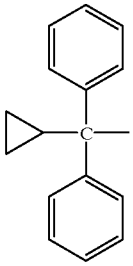 | 108-10 | 108a | 108m | 108y |
| 109 | 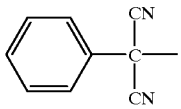 | 109-10 | 109a | 109m | 109y |
| 110 | 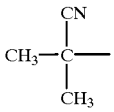 | 110-10 | 110a | 110m | 110y |
| 111 | 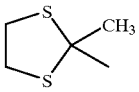 | 111-10 | 111a | 111m | 111y |
Y—NHNH—X
| | X = | | | |
|---|---|---|---|---|
| Y = | 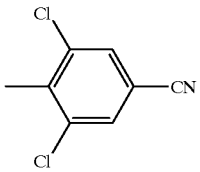 | 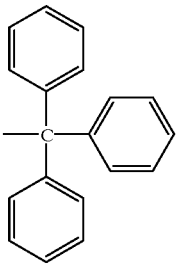 | 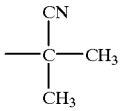 | 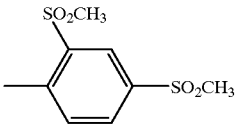 |
| | | | | | |
|---|---|---|---|---|---|
| 112 | 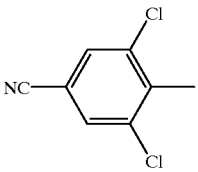 | 112-11 | 112-12 | 112-13 | 112-14 |

-continued
| | | | | | |
|---|---|---|---|---|---|
| 113 | 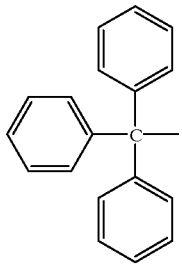 | 113-11 | 113-12 | 113-13 | 113-14 |
| 114 | 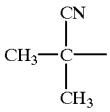 | 114-11 | 114-12 | 114-13 | 114-14 |
| 115 | 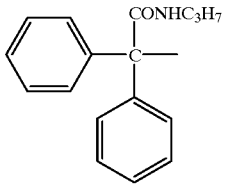 | 115-11 | 115-12 | 115-13 | 115-14 |
| 116 | 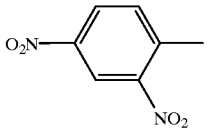 | 116-11 | 116-12 | 116-13 | 116-14 |
| 117 | 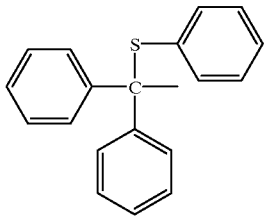 | 117-11 | 117-12 | 117-13 | 117-14 |
118
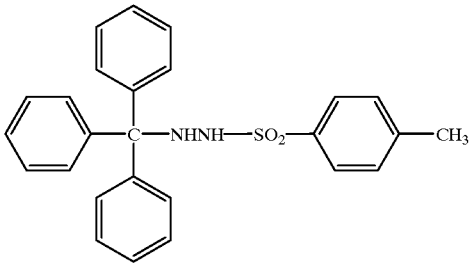
119
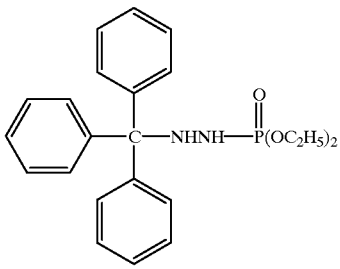

-continued
120
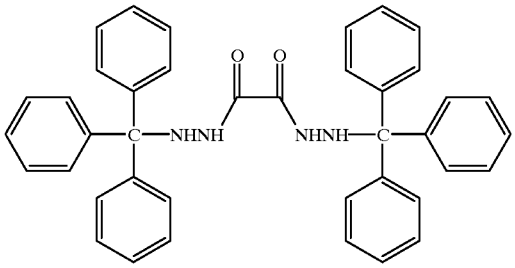
121
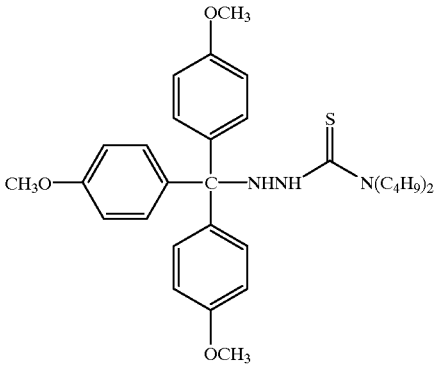
122
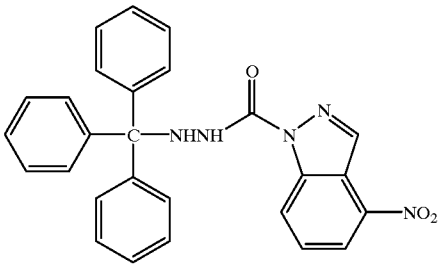
123
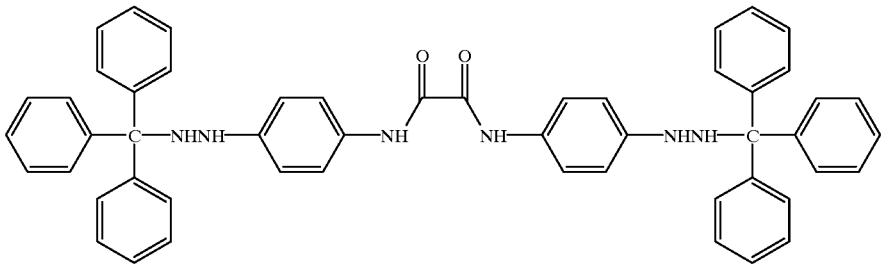
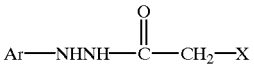
| | Ar = | X = —OH | —SH | —NHCOCF$_3$ | —NHSO$_2$CH$_3$ | —NHSO$_2$ph | —N(CH$_3$)$_2$ |
|---|---|---|---|---|---|---|---|
| 124 | 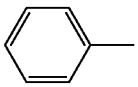 | 124a | 124b | 124c | 124d | 124e | 124f |

-continued
| | | | | | | | |
|---|---|---|---|---|---|---|---|
| 125 | 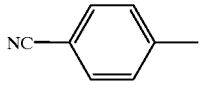 | 125a | 125b | 125c | 125d | 125e | 125f |
| 126 | 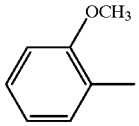 | 126a | 126b | 126c | 126d | 126e | 126f |
| 127 | 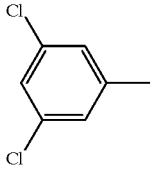 | 127a | 127b | 127c | 127d | 127e | 127f |
| 128 | 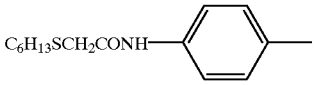 | 128a | 128b | 128c | 128d | 128e | 128f |
| 129 | 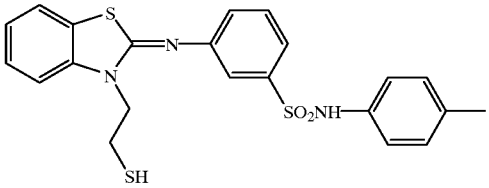 | 129a | 129b | 129c | 129d | 129e | 129f |
| 130 | 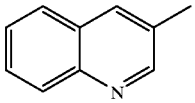 | 130a | 130b | 130c | 130d | 130e | 130f |
| 131 | 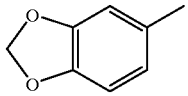 | 131a | 131b | 131c | 131d | 131e | 131f |
| 132 | 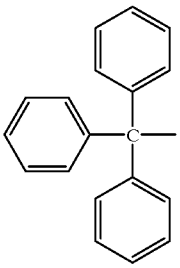 | 132a | 132b | 132c | 132d | 132e | 132f |
| 133 | 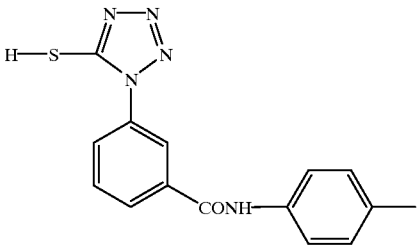 | 133a | 133b | 133c | 133d | 133e | 133f |

-continued

| | | | | | | | |
|---|---|---|---|---|---|---|---|
| 134 | 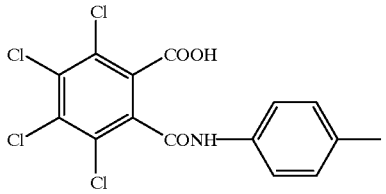 | 134a | 134b | 134c | 134d | 134e | 134f |
| 135 | 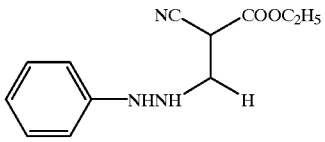 | | | | | | |
| 136 | 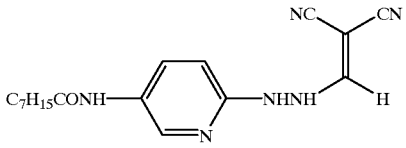 | | | | | | |
| 137 | 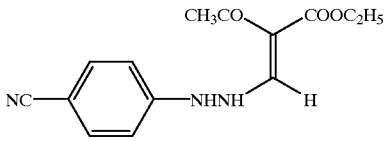 | | | | | | |
| 138 | 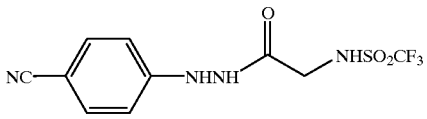 | | | | | | |
| 139 | 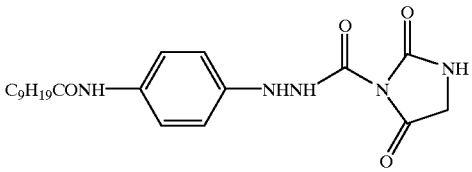 | | | | | | |
| 140 | 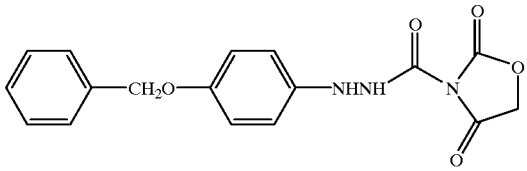 | | | | | | |

The hydrazine derivatives of formula (H) may be used alone or in admixture of two or more.

In addition to the above-described ones, the following hydrazine derivatives are also preferable for use in the practice of the invention. If desired, any of the following hydrazine derivatives may be used in combination with the hydrazine derivatives of formula (H). The hydrazine derivatives which are used herein can be synthesized by various methods as described in the following patents.

Exemplary hydrazine derivatives which can be used herein include the compounds of the chemical formula [1] in JP-B 77138/1994, more specifically the compounds described on pages 3 and 4 of the same; the compounds of the general formula (I) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1–17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same;

the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group capable of forming an intramolecular hydrogen bond with the hydrogen atom of hydrazine described in EP 713131A, especially compounds of the general formulae (A), (B), (C), (D), (E), and (F), more specifically compounds N-1 to N-30 described therein; and the compounds of the general formula (1) in EP 713131A, more specifically compounds D-1 to D-55 described therein.

Also useful are the hydrazine derivatives described in "Known Technology," Aztech K.K., Mar. 22, 1991, pages 25–34 and Compounds D-2 and D-39 described in JP-A 86354/1987, pages 6–7.

In the practice of the invention, the hydrazine nucleating agent is used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethyl sulfoxide and methyl cellosolve.

A well-known emulsifying dispersion method may be used for dissolving the hydrazine derivative with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the hydrazine derivative in powder form in a suitable solvent in a ball mill, colloidal mill or ultrasonic mixer.

The hydrazine nucleating agent may be added to an image forming layer or any other layer on the image forming layer side of a support, and preferably to the image forming layer or a layer disposed adjacent thereto.

The hydrazine derivative is preferably used in an amount of $1\times10^{-6}$ mol to 1 mol, more preferably $1\times10^{-5}$ mol to $5\times10^{-1}$ mol, and most preferably $2\times10^{-5}$ mol to $2\times10^{-1}$ mol per mol of silver halide.

Sensitizing Dye

A sensitizing dye may be used in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in *Research Disclosure*, Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and process cameras.

Exemplary dyes for spectral sensitization to red light include compounds I-1 to I-38 described in JP-A 18726/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for He-Ne laser, red semiconductor laser and LED light sources.

It is also advantageous to spectrally sensitize silver halide grains in the wavelength range of 750 to 1,400 nm. Such spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole or imidazole nucleus. Preferred examples of the useful merocyanine dye contain an acidic nucleus such as a thiohydantoin, rhodanine, oxazolidinedione, thiazolinedione, barbituric acid, thiazolinone, malononitrile or pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, BP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether bond-containing substituent, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, Publication of International Patent Application No. 50111/1993, BP 1,467,638, and U.S. Pat. No. 5,281,515.

Also useful in the practice of the invention are dyes capable of forming the J-band as disclosed in U.S. Pat. Nos. 5,510,236, 3,871,887 (Example 5), JP-A 96131/1990 and 48753/1984.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in *Research Disclosure*, Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been ascertained effective. The sensitizing dye may be added to the emulsion at any stage or step before the emulsion is coated, for example, during the silver halide grain forming step and/or a stage prior to the desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

The amount of the sensitizing dye used may be an appropriate amount complying with sensitivity and fog although the preferred amount is about 10–6 to 1 mol, more preferably $10^{-4}$ to $10^{-1}$ mol per mol of the silver halide in the photosensitive layer.

Antifoggant

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in BP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Preferred antifoggants are organic halides, for example, the compounds described in JP-A 119624/1975, 120328/1975, 121332/1976, 58022/1979, 70543/1981, 99335/1981, 90842/1984, 129642/1986, 129845/1987, 08191/1994, 5621/1995, 2781/1995, 15809/1996, U.S. Pat. Nos. 5,340,712, 5,369,000, and 5,464,737.

The antifoggant may be added in any desired form such as solution, powder or solid particle dispersion. The solid particle dispersion of the antifoggant may be prepared by well-known comminuting means such as ball mills, vibrating ball mills, sand mills, colloidal mills, jet mills, and roller mills. Dispersing aids may be used for facilitating dispersion.

It is sometimes advantageous to add a mercury (II) salt to an emulsion layer as an antifoggant though not necessary in the practice of the invention. Mercury (II) salts preferred to this end are mercury acetate and mercury bromide. The mercury (II) salt is preferably added in an amount of $1\times10^{-9}$ mol to $1\times10^{-3}$ mol, more preferably $1\times10^{-8}$ mol to $1\times10^{-4}$ mol per mol of silver coated.

Still further, the photothermographic element of the invention may contain a benzoic acid type compound for the purposes of increasing sensitivity and restraining fog. Any of benzoic acid type compounds may be used although examples of the preferred structure are described in U.S. Pat. Nos. 4,784,939 and 4,152,160, Japanese Patent Application Nos. 98051/1996, 151241/1996, and 151242/1996. The benzoic acid type compound may be added to any site in the photosensitive element, preferably to a layer on the same side as the image forming layer (or photosensitive layer), and more preferably an organic silver salt-containing layer. The benzoic acid type compound may be added at any step in the preparation of a coating solution. Where it is contained in an organic silver salt-containing layer, it may be added at any step from the preparation of the organic silver salt to the preparation of a coating solution, preferably after the preparation of the organic silver salt and immediately before coating. The benzoic acid type compound may be added in any desired form including powder, solution and fine particle dispersion. Alternatively, it may be added in a solution form after mixing it with other additives such as a sensitizing dye, reducing agent and toner. The benzoic acid type compound may be added in any desired amount, preferably $1\times10^{-6}$ to 2 mol, more preferably $1\times10^{-3}$ to 0.5 mol per mol of silver.

In the element of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—S—M and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred heteroaromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms), and aryl groups (optionally substituted). Illustrative, non-limiting examples of the mercapto-substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptoyrimidine monohydrate, 2-amino-5-mercapto-1,3,4-thiadiazole, 3-amino-5-mercapto-1,2,4-triazole, 4-hydroxy-2-ercaptopyrimidine, 2-mercaptopyrimidine, 4,6-diamino-2-ercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)-benzenesulfonate, N-methyl-N'-{3-(5-mercaptotetrazolyl)-phenyl}urea, and 2-mercapto-4-phenyloxazole.

These mercapto compounds are preferably added to the emulsion layer in amounts of 0.0001 to 1.0 mol, more preferably 0.001 to 0.3 mol per mol of silver.

In the image forming layer (or photosensitive layer), polyhydric alcohols (e.g., glycerin and diols as described in U.S. Pat. No. 2,960,404), fatty acids and esters thereof as described in U.S. Pat. No. 2,588,765 and 3,121,060, and silicone resins as described in BP 955,061 may be added as a plasticizer and lubricant.

Protective Layer

A surface protective layer may be provided in the photothermographic element of the present invention for the purpose of preventing sticking of the image forming layer.

The surface protective layer is based on a binder which may be any desired polymer, although the layer preferably contains 100 mg/m$^2$ to 5 g/m$^2$ of a polymer having a carboxylic acid residue. The polymers having carboxylic acid residues include natural polymers (e.g., gelatin and alginic acid), modified natural polymers (e.g., carboxymethyl cellulose and phthalated gelatin), and synthetic polymers (e.g., polymethacrylate, polyacrylate, polyalkyl methacrylate/acrylate copolymers, and polystyrene/polymethacrylate copolymers). The content of the carboxylic acid residue is preferably 10 mmol to 1.4 mol per 100 g of the polymer. The carboxylic acid residue may form a salt with an alkali metal ion, alkaline earth metal ion or organic cation.

In the surface protective layer, any desired anti-sticking material may be used. Examples of the anti-sticking material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof. Crosslinking agents for crosslinking, surfactants for ease of application, and other addenda are optionally added to the surface protective layer.

In the image forming layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699. The filer dyes are used in such amounts that the layer may have an absorbance of 0.1 to 3, especially 0.2 to 1.5 at the exposure wavelength.

In the photosensitive layer serving as the image forming layer, a variety of dyes and pigments may be used from the standpoints of improving tone and preventing irradiation. Any desired dyes and pigments may be used in the photosensitive layer. Useful pigments and dyes include those described in Colour Index and both organic and inorganic, for example, pyrazoloazole dyes, anthraquinone dyes, azo dyes, azomethine dyes, oxonol dyes, carbocyanine dyes, styryl dyes, triphenylmethane dyes, indoaniline dyes, indophenol dyes, and phthalocyanine dyes. The preferred dyes used herein include anthraquinone dyes (e.g., Compounds 1 to 9 described in JP-A 341441/1993 and Compounds 3–6 to 3–18 and 3–23 to 3–38 described in JP-A 165147/1993), azomethine dyes (e.g., Compounds 17 to 47 described in JP-A 341441/1993), indoaniline dyes (e.g., Compounds 11 to 19 described in JP-A 289227/1993, Compound 47 described in JP-A 341441/1993 and Compounds 2–10 to 2–11 described in JP-A 165147/1993), and azo dyes (e.g., Compounds 10 to 16 described in JP-A 341441/1993). The dyes and pigments may be added in any desired form such as solution, emulsion or solid particle dispersion or in a form mordanted with polymeric mordants. The amounts of these compounds used are determined in accordance with the desired absorption although the compounds are generally used in amounts of $1\times10^{-6}$ g to 1 g per square meter of the recording element.

In one preferred embodiment, the photothermographic element of the invention is a one-side photosensitive element having at least one photosensitive layer containing a silver halide emulsion and serving as the image forming layer on one side and a back layer on the other side of the support.

The back layer preferably exhibits a maximum absorbance of about 0.3 to 2.0 in the desired wavelength range. When the desired wavelength range is from 750 to 1,400 nm, the back layer is preferably an antihalation layer having an optical density of 0.001 to less than 0.5, especially 0.001 to less than 0.3, in the wavelength range of 750 to 360 nm. When the desired wavelength range is up to 750 nm, the back layer is preferably an antihalation layer having a maximum absorbance of 0.3 to 2.0 at the desired range before image formation and an optical density of 0.005 to less than 0.3 at 360 to 750 nm after image formation. The method of reducing the optical density after image formation to the above-defined range is not critical. For example, the density given by a dye can be reduced by thermal decolorization as described in Belgian Patent No. 733706, or the density is reduced through decolorization by light irradiation as described in JP-A 17833/1979.

Where an antihalation dye is used in the invention, it may be selected from various compounds insofar as it has the desired absorption in the wavelength range, is sufficiently low absorptive in the visible region after processing, and provides the back layer with the preferred absorbance profile. Exemplary antihalation dyes are given below though the dyes are not limited thereto. Useful dyes which are used alone are described in JP-A 56458/1984, 216140/1990, 13295/1995, 11432/1995, U.S. Pat. No. 5,380,635, JP-A 68539/1990, page 13, lower-left column, line 1 to page 14, lower-left column, line 9, and JP-A 24539/1991, page 14, lower-left column to page 16, lower-right column. Useful dyes which will ecolorize during processing are disclosed in JP-A 39136/1977, 132334/1978, 501480/1981, 16060/1982, 68831/1982, 101835/1982, 182436/1984, 36145/1995, 199409/1995, JP-B 33692/1973, 16648/1975, 41734/1990, U.S. Pat. Nos. 4,088,497, 4,283,487, 4,548,896, and 5,187,049.

In the practice of the invention, the binder used in the back layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

In the one-side photothermographic element of the invention, a matte agent may be added to the surface protective layer for the photosensitive emulsion layer and/or the back layer or surface protective layer therefor for improving transportation. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, ureaformaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 μm to 30 μm are preferably used in the practice of the invention. The particle size distribution of the matte agent may be either narrow or wide. Nevertheless, since the haze and surface luster of coating are largely affected by the matte agent, it is preferred to adjust the particle size, shape and particle size distribution of a matte agent as desired during preparation of the matte agent or by mixing plural matte agents.

In one preferred embodiment of the invention, the matte agent is added to the back layer. The back layer should preferably have a degree of matte as expressed by a Bekk smoothness of 10 to 1,200 seconds, more preferably 50 to 700 seconds.

In the practice of the invention, the matte agent is preferably added to an outermost surface layer on the photothermographic element or a layer serving as the outermost surface layer or a layer near the outer surface, and also preferably to a layer serving as the so-called protective layer. The emulsion-bearing side surface may have any degree of matte insofar as no star dust failures occur although a Bekk smoothness of 10 to 10,000 seconds, especially 10 to 2,000 seconds is preferred.

The emulsion used in the photothermographic element according to the one preferred embodiment of the invention is contained in one or more layers on a support. In the event of single layer construction, it should contain an organic silver salt, silver halide, developing agent, and binder, and other optional additives such as a toner, coating aid and other auxiliary agents. In the event of two-layer construction, a first emulsion layer which is generally a layer disposed adjacent to the support should contain an organic silver salt and silver halide and a second emulsion layer or both the layers contain other components. Also envisioned herein is a two-layer construction consisting of a single emulsion layer containing all the components and a protective topcoat. In the case of multi-color sensitive photothermographic material, a combination of such two layers may be employed for each color. Also a single layer may contain all necessary components as described in U.S. Pat. No. 4,708,928. In the case of multi-dye, multi-color sensitive photothermographic material, emulsion (or photosensitive) layers are distinctly supported by providing a functional or non-functional barrier layer therebetween as described in U.S. Pat. No. 4,460,681.

A backside resistive heating layer as described in U.S. Pat. Nos. 4,460,681 and 4,374,921 may be used in a photographic thermographic image recording system according to the present invention.

According to the invention, a hardener may be used in various layers including an image forming layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

A surfactant may be used for the purposes of improving coating and electric charging properties. The surfactants used herein may be nonionic, anionic, cationic and fluorinated ones. Examples include fluorinated polymer surfactants as described in JP-A 170950/1987 and U.S. Pat. No. 5,380,644, fluorochemical surfactants as described in JP-A 244945/1985 and 188135/1988, polysiloxane surfactants as described in U.S. Pat. No. 3,885,965, and polyalkylene oxide and anionic surfactants as described in JP-A 301140/1994.

Support

According to the invention, the thermographic emulsion may be coated on a variety of supports. Typical supports include polyester film, subbed polyester film, poly(ethylene terephthalate) film, polyethylene naphthalate film, cellulose nitrate film, cellulose ester film, poly(vinyl acetal) film, polycarbonate film and related or resinous materials, as well as glass, paper, metals, etc. Often used are flexible substrates, typically paper supports, specifically baryta paper and paper supports coated with partially acetylated α-olefin polymers, especially polymers of α-olefins having 2 to 10 carbon atoms such as polyethylene, polypropylene, and ethylene-butene copolymers. The supports are either transparent or opaque, preferably transparent. Especially preferred is a biaxially oriented polyethylene terephthalate (PET) film of about 75 to 200 μm thick.

When plastic film is passed through a thermographic processor where it will encounter a temperature of at least 80° C., the film experiences dimensional shrinkage or expansion. When the thermographic element as processed is intended for printing plate purposes, this dimensional shrinkage or expansion gives rise to a serious problem against precision multi-color printing. Therefore, the invention favors the use of a film experiencing a minimal dimensional change, that is, a film which has been biaxially stretched and then properly treated for mitigating the internal distortion left after stretching and for preventing distortion from being generated by thermal shrinkage during subsequent heat development. One exemplary material is polyethylene terephthalate (PET) film which has been heat treated at 100 to 210° C. prior to the coating of a photothermographic emulsion. Also useful are materials having a high glass transition temperature, for example, polyether ethyl ketone, polystyrene, polysulfone, polyether sulfone, polyarylate, and polycarbonate.

The photothermographic element of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312, insoluble inorganic salts as described in U.S. Pat. No. 3,428,451, or tin oxide microparticulates as described in JP-A 252349/1985 and 104931/1982.

A method for producing color images using the photothermographic element of the invention is as described in JP-A 13295/1995, page 10, left column, line 43 to page 11, left column, line 40. Stabilizers for color dye images are exemplified in BP 1,326,889, U.S. Pat. Nos. 3,432,300, 3,698,909, 3,574,627, 3,573,050, 3,764,337, and 4,042,394.

In the practice of the invention, the thermographic photographic emulsion can be applied by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and BP 837,095.

In the photothermographic element of the invention, there may be contained additional layers, for example, a dye accepting layer for accepting a mobile dye image, an opacifying layer when reflection printing is desired, a protective topcoat layer, and a primer layer well known in the photothermographic art. The photosensitive material of the invention is preferably such that only a single sheet of the photosensitive material can form an image. That is, it is preferred that a functional layer necessary to form an image such as an image receiving layer does not constitute a separate member.

Processing

The photothermographic element of the invention may be developed by any desired method although it is generally developed by heating after imagewise exposure. Preferred examples of the heat developing machine used include heat developing machines of the contact type wherein the photothermographic element is contacted with a heat source in the form of a heat roller or heat drum as described in JP-B 56499/1993, Japanese Patent No. 684453, JP-A 292695/1997, 297385/1997, and WO 95/30934; and heat developing machines of the non-contact type as described in JP-A 13294/1995, WO 97/28489, 97/28488, and 97/28487. The heat developing machines of the non-contact type are especially preferred examples. The preferred developing temperature is about 80 to 250° C., more preferably 100 to 140° C. The preferred developing time is about 1 to 180 seconds, more preferably about 10 to 90 seconds.

One effective means for preventing the photothermographic element from experiencing process variations due to dimensional changes during heat development is a method (known as a multi-stage heating method) of heating the element at a temperature of 80° C. to less than 115° C. (preferably up to 113° C.) for at least 5 seconds so that no images are developed and thereafter, heating at a temperature of at least 110° C. (preferably up to 130° C.) for heat development to form images.

Any desired technique may be used for the exposure of the photothermographic element of the invention. The preferred light source for exposure is a laser, for example, a gas laser, YAG laser, dye laser or semiconductor laser. A semiconductor laser combined with a second harmonic generating device is also useful.

Owing to low haze upon exposure, the photothermographic element of the invention tends to generate interference fringes. Known techniques for preventing generation of interference fringes are a technique of obliquely directing laser light to a photothermographic element as disclosed in JP-A 113548/1993 and the utilization of a multi-mode laser as disclosed in WO 95/31754. Exposure is preferably carried out in combination with these techniques.

Upon exposure of the photothermographic element of the invention, exposure is preferably made by overlapping laser light so that no scanning lines are visible, as disclosed in SPIE, Vol. 169, Laser Printing 116–128 (1979), JP-A 51043/1992, and WO 95/31754.

Developing Apparatus

Referring to FIG. 1, there is schematically illustrated one exemplary heat developing apparatus for use in the processing of the photothermographic element according to the invention. FIG. 1 is a side elevation of the heat developing apparatus which includes a cylindrical heat drum 2 having a halogen lamp 1 received therein as a heating means, and an endless belt 4 trained around a plurality of feed rollers 3 so that a portion of the belt 4 is in close contact with the drum 2. A length of photothermographic element 5 is fed and guided by pairs of guide rollers to between the heat drum 2 and the belt 4. The element 5 is fed forward while it is clamped between the heat drum 2 and the belt 4. While the element 5 is fed forward, it is heated to the developing temperature whereby it is heat developed. In the heat developing apparatus of the drum type, the luminous intensity distribution of the lamp is optimized so that the temperature in the transverse direction may be precisely controlled.

The element 5 exits at an exit 6 from between the heat drum 2 and the belt 4 where the element is released from bending by the circumferential surface of the heat drum 2. A correcting guide plate 7 is disposed in the vicinity of the exit 6 for correcting the element 5 into a planar shape. A zone surrounding the guide plate 7 is temperature adjusted so that the temperature of the element 5 may not lower below the predetermined level (e.g., 90° C.).

Disposed downstream of the exit 6 are a pair of feed rollers 8. A pair of planar guide plates 9 are disposed downstream of and adjacent to the feed rollers 8 for guiding the element 5 while keeping it planar. Another pair of feed rollers 10 are disposed downstream of and adjacent to the guide plates 9. The planar guide plates 9 have such a length that the element 5 is fully cooled, typically below 30° C., while it passes over the plates 9. The means associated with the guide plates 9 for cooling the element 5 are cooling fans 11.

Although the belt conveyor type heat developing apparatus has been described, the invention is not limited thereto. Use may be made of heat developing apparatus of varying constructions such as disclosed in JP-A 13294/1995. In the case of a multi-stage heating mode which is preferably used in the practice of the invention, two or more heat sources having different heating temperatures are disposed in the illustrated apparatus so that the element may be continuously heated to different temperatures.

EXAMPLE

Examples of the invention are given below by way of illustration and not by way of limitation.

Example 1

Silver Halide Emulsion A

In 700 ml of water were dissolved 11 g of phthalated gelatin, 30 mg of potassium bromide, and 10 mg of sodium benzenethiosulfonate. The solution was adjusted to pH 5.0 at a temperature of 55° C. To the solution, 159 ml of an aqueous solution containing 18.6 g of silver nitrate and an aqueous solution containing 1 mol/liter of potassium bromide were added over 6½ minutes by the controlled double jet method while maintaining the solution at pAg 7.7. Then, 476 ml of an aqueous solution containing 55.5 g of silver nitrate and an aqueous halide solution containing 1 mol/liter of potassium bromide were added over 28½ minutes by the controlled double jet method while maintaining the solution at pAg 7.7. Thereafter, the pH of the solution was lowered to cause flocculation and sedimentation for desalting. Further, 0.17 g of Compound A and 23.7 g of deionized gelatin (calcium content below 20 ppm) were added to the solution, which was adjusted to pH 5.9 and pAg 8.0. There were obtained cubic grains of silver halide having a mean grain size of 0.11 μm, a coefficient of variation of the projected area of 8%, and a (100) face proportion of 93%.

The thus obtained silver halide grains were heated at 60° C., to which 76 μmol of sodium benzenethiosulfonate was added per mol of silver. After 3 minutes, 154 μmol of sodium thiosulfate was added and the emulsion was ripened for 100 minutes.

Thereafter, the emulsion was maintained at 40° C., and with stirring, $6.4\times10^{-4}$ mol of Sensitizing Dye A and $6.4\times10^{-3}$ mol of Compound B were added per mol of silver halide. After 20 minutes, the emulsion was quenched to 30° C., completing the preparation of a silver halide emulsion A.

Preparation of Organic Acid Silver Dispersion Organic Acid Silver A

While a mixture of 4.4 g of arachic acid, 39.4 g of behenic acid, and 770 ml of distilled water was stirred at 85° C., 103 ml of iN NaOH aqueous solution was added over 60 minutes. The solution was reacted for 240 minutes, then cooled to 750° C. Next, 112.5 ml of an aqueous solution containing 19.2 g of silver nitrate was added over 45 seconds to the solution, which was left to stand for 20 minutes and cooled to 30° C. Thereafter, the solids were separated by suction filtration and washed with water until the water filtrate reached a conductivity of 30 μS/cm. The thus obtained solids were handled as a wet cake without drying. To 100 g as dry solids of the wet cake, 5 g of polyvinyl alcohol PVA-205 (Kurare K.K.) and water were added to a total weight of 500 g. This was pre-dispersed in a homomixer.

The pre-dispersed liquid was processed three times by a dispersing machine Micro-Fluidizer M-110S-EH (with G10Z interaction chamber, manufactured by Microfluidex International Corporation) which was operated under a pressure of 1,750 kg/cm$^2$. There was obtained an organic acid silver dispersion A. The organic acid silver grains in this dispersion were acicular grains having a mean minor axis (or breadth) of 0.04 μm, a mean major axis (or length) of 0.8 μm, and a coefficient of variation of 30%. It is noted that particle dimensions were measured by Master Sizer X (Malvern Instruments Ltd.). The desired dispersion temperature was set by mounting serpentine heat exchangers at the front and rear sides of the interaction chamber and adjusting the temperature of refrigerant.

Solid Particle Dispersion of 1,1-Bis(2-hydroxy-3,5-dimethylphenyl)-3,5,5-trimethylhexane Sensitizing Dye A

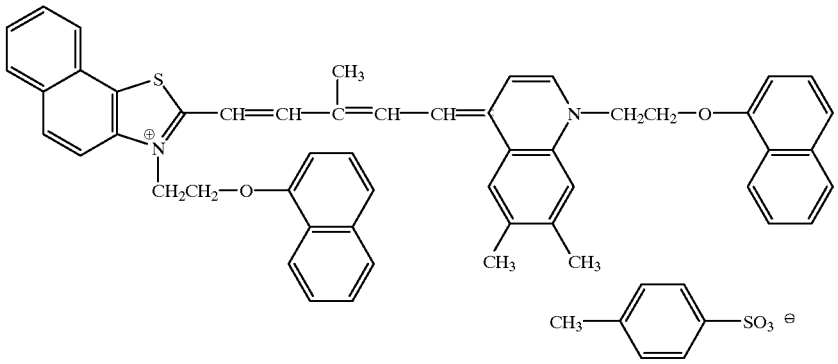

Compound A

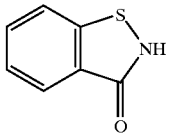

Compound B

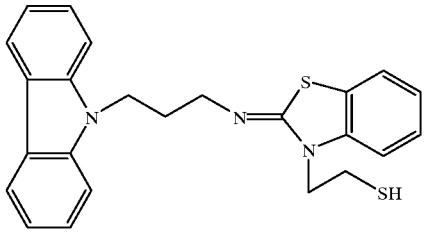

To 20 g of 1,1-bis(2-hydroxy-3,5-dimethylphenyl)-3,5,5-trimethylhexane were added 3.0 g of modified polyvinyl alcohol MP-203 (Kurare K.K.) and 77 ml of water. They were thoroughly agitated to form a slurry, which was allowed to stand for 3 hours. A vessel was charged with the slurry together with 360 g of zirconia beads having a mean diameter of 0.5 mm. A dispersing machine 1/4G Sand Grinder Mill (Imex K.K.) was operated for 3 hours for dispersion, obtaining a solid particle dispersion of the reducing agent in which particles with a diameter of 0.3 to 1.0 μm accounted for 80% by weight.

Solid Particle Dispersion of Tribromomethylphenylsulfone

To 30 g of tribromomethylphenylsulfone were added 0.5 g of hydroxypropylmethyl cellulose, 0.5 g of Compound C, and 88.5 g of water. They were thoroughly agitated to form a slurry, which was allowed to stand for 3 hours. Following the steps used in the preparation of the solid particle dispersion of the reducing agent, a solid particle dispersion of the antifoggant was prepared in which particles with a diameter of 0.3 to 1.0 μm accounted for 80% by weight.

Solution or Water Dispersion of Nucleating Agent

Formulation A: Methanol Solution

In 10 ml of methanol was dissolved 2 g of the nucleating agent.

Formulation B: Solid Dispersion

To 97 g of water were added 2 g of the nucleating agent, 0.5 g of hydroxypropylmethyl cellulose, and 0.5 g of Surfactant C. They were thoroughly agitated to form a slurry, which was allowed to stand for 3 hours. Following the steps used in the preparation of the solid particle dispersion of the reducing agent, a solid particle dispersion of the nucleating agent was prepared in which particles with a diameter of 0.3 to 1.0 μm accounted for 80% by weight.

Surfactant C

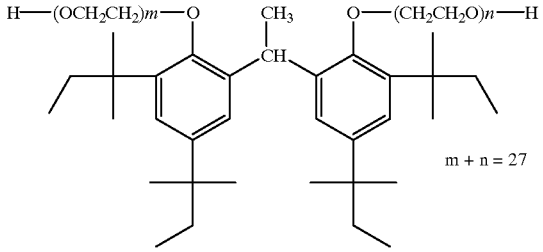

Formulation C: Micelle Dispersed Solution 1

To 97.5 g of water were added 2 g of the nucleating agent and 0.5 g of Surfactant M. They were thoroughly agitated and subjected to ultrasonic dispersion at 60° C. for one hour.

Surfactant M

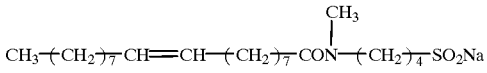

Formulation D: Micelle Dispersed Solution 2

To 98 g of water was added 2 g of the nucleating agent. They were thoroughly agitated and subjected to ultrasonic dispersion at 60° C. for one hour.

The nucleating agents used were Compounds 2, 3, 10, 17, 22, 25, and 29 shown in Tables 1 to 3, and the following compounds N-1 and N-2 were used as comparative nucleating agents.

N-1

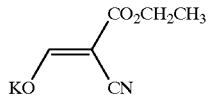

N-2

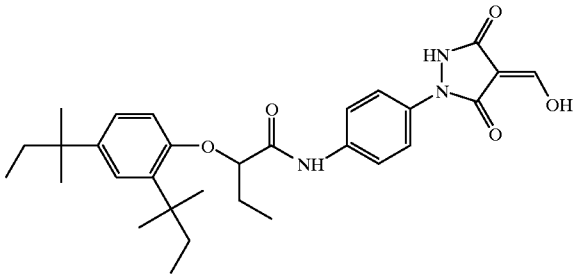

Solid Particle Dispersion of Hydrazine Derivative

To 10 g of Hydrazine Derivative 125e (see Table 24) were added 0.5 g of hydroxypropylmethyl cellulose, 0.5 g of Surfactant C, and 89 g of water. They were thoroughly agitated to form a slurry, which was allowed to stand for 3 hours. Following the steps used in the preparation of the solid particle dispersion of the reducing agent, a solid particle dispersion of the hydrazine derivative was prepared in which particles with a diameter of 0.3 to 1.0 μm accounted for 80% by weight.

Emulsion Laver Coating Solution

To the above-prepared organic acid silver microcrystalline dispersion A (corresponding to 1 mol of silver) were added the above-prepared silver halide emulsion A and the binder and addenda described below. Water was added thereto to form an emulsion layer coating solution.

| | |
|---|---|
| Binder: LACSTAR 3307B (Dai-Nippon Ink & Chemicals K.K., SBR latex, Tg 17° C.) | as solids 470 g |
| 1,1-bis (2-hydroxy-3,5-dimethylphenyl)-3,5,5-trimethylhexane | as solids 110 g |
| Tribromomethylphenylsulfone | as solids 25 g |
| Sodium benzenethiosulfonate | 0.25 g |
| Polyvinyl alcohol MP-203 (Kurare K.K.) | 46 g |
| Compound A-5 (formula (F)) | 0.12 mol |
| Solid dispersion of Hydrazine | 0.01 mol |
| Derivative 125e | as hydrazine derivative |
| Nucleating agent (Table 26) | 0.01 mol |
| (added by the procedure shown in Table 26) | as nucleating agent |
| Dyestuff A | 0.62 g |
| Silver halide emulsion A | as Ag 0.05 mol |

Dyestuff A

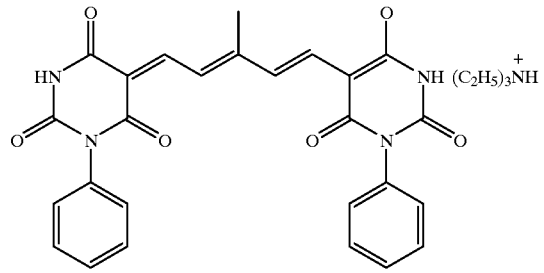

Emulsion Surface Protective Laver Coating Solution

A surface protective layer coating solution was prepared by adding 3.75 g of $H_2O$ to 109 g of a polymer latex having a solids content of 27.5% (methyl methacrylate/styrene/2-ethylhexyl acrylate/2-hydroxyethyl methacrylate/acrylic acid=59/9/26/5/1 copolymer, Tg 55° C.), then adding 4.5 g of benzyl alcohol as a film-forming aid, 0.45 g of Compound D, 0.125 g of Compound E, 0.0125 mol of Compound F, and 0.225 g of polyvinyl alcohol PVA-217 (Kurare K.K.), and diluting with water to a total weight of 150 g.

Compound D

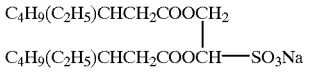

Compound E

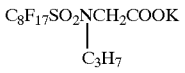

Compound F

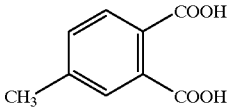

PET Supports with Back and Undercoat Layers (1) Support

Using terephthalic acid and ethylene glycol, a polyethylene terephthalate (PET) having an intrinsic viscosity of 0.66 as measured in a phenol/tetrachloroethane 6/4 (weight ratio) mixture at 25° C. was prepared in a conventional manner. After the PET was pelletized and dried at 130° C. for 4 hours, it was melted at 300° C., extruded through a T-shaped die, and quenched to form an unstretched film having a thickness sufficient to give a thickness of 120 μm after thermosetting.

The film was longitudinally stretched by a factor of 3.3 by means of rollers rotating at different circumferential speeds and then transversely stretched by a factor of 4.5 by means of a tenter. The temperatures in these stretching steps were 110° C. and 130° C., respectively. Thereafter, the film was thermoset at 240° C. for 20 seconds and then transversely relaxed 4% at the same temperature. Thereafter, with the chuck of the tenter being slit and the opposite edges being knurled, the film was taken up under a tension of 4.8 kg/cm$^2$. In this way, a film of 2.4 m wide, 3,500 m long and 120 μm thick was obtained in a roll form.

| (2) Undercoat layer (a) | |
|---|---|
| Polymer latex-1 (styrene/butadiene/hydroxyethyl methacrylate/divinyl benzene = 67/30/2.5/0.5 wt %) | 160 mg/m$^2$ |
| 2,4-dichloro-6-hydroxy-s-triazine | 4 mg/m$^2$ |
| Matte agent (polystyrene, mean particle size 2.4 μm) | 3 mg/m$^2$ |
| (3) Undercoat layer (b) | |
| Alkali-treated gelatin (Ca2+ content 30 ppm, jelly strength 230 g) | 50 mg/m$^2$ |
| Dyestuff A | coverage to give an optical density of 0.7 at 780 nm |
| (4) Conductive layer | |
| Jurimer ET410 (Nippon Junyaku K.K.) | 38 mg/m$^2$ |
| $SnO_2$/Sb (9/1 weight ratio, mean particle size 0.25 μm) | 120 mg/m$^2$ |
| Matte agent (polymethyl methacrylate, mean particle size 5 μm) | 7 mg/m$^2$ |
| Melamine resin | 13 mg/m$^2$ |

-continued

| (5) Protective layer | |
|---|---|
| Chemipearl S-120 (Mitsui Chemical K.K.) | 500 mg/m$^2$ |
| Snowtex C (Nissan Chemical K.K.) | 40 mg/m$^2$ |
| Denacol EX-614B (Nagase Chemicals K.K.) | 30 mg/m$^2$ |

The undercoat layer (a) and the undercoat layer (b) were successively coated on both sides of the PET support and respectively dried at 180° C. for 4 minutes. Then, the conductive layer and the protective layer were successively coated on one side of the support where undercoat layers (a) and (b) had been coated, and respectively dried at 180° C. for 4 minutes, completing the PET support having the back and undercoat layers.

The thus prepared PET support having back and undercoat layers was passed through a heat treating zone having an overall length of 200 m and set at 200° C. at a feed speed of 20 m/min under a tension of 3 kg/M$^2$. Thereafter, the support was passed through a zone set at 40° C. for 15 seconds and taken up into a roll under a tension of 10 kg/cm$^2$.

Photothermographic Element

The emulsion layer coating solution was applied onto the undercoat side of the PET support having the back and undercoat layers to a silver coverage of 1.6 g/m$^2$. The emulsion surface protective layer coating solution was applied thereon so that the coverage of the polymer latex (as solids) was 2.0 g/m$^2$, obtaining photothermographic element samples.

Processing

The coated samples were exposed to xenon flash light for an emission time of $10^{-6}$ sec through an interference filter having a peak at 780 nm and a step wedge.

The heat developing apparatus shown in FIG. 1 was modified by arranging two heat sources in the same structure as in the heat developing apparatus shown in FIG. 3 of JP-A 13294/1995, so that the film could be heated in two consecutive stages. Using this apparatus, the exposed samples were heat developed. Specifically, they were first heated at 105° C. for 10 seconds (conditions under which no images were developed), then at 118° C. for 17 seconds.

Photographic Properties

The resulting images were measured for visible density by a Macbeth TD904 densitometer. The contrast was expressed by the gradient (γ) of a straight line connecting density points 0.1 and 3.0 in a graph wherein the logarithm of the exposure is on the abscissa. Gamma values of at least 10 are practically acceptable, with gamma values of at least 15 being preferable.

The image retention upon printing of an image to PS plates was evaluated by the following method. Using a machine-plate printer S-FNRIII by Fuji Photo Film Co., Ltd. and as an original the sample which had been exposed and heat developed by the same procedure as the above photographic test, an original image was printed on a presensitized (PS) plate under standard conditions (an exposure adjusted such that PS plates FNN by Fuji Photo Film Co., Ltd. were exposed to 1:1). The printing was repeated 50 cycles. The density of a Dmin area of the sample before and after exposure for printing was measured by means of a Macbeth TD904 densitometer (UV density), obtaining a change of Dmin (ΔDmin). ΔDmin values of 0.01 or lower are practically acceptable.

To estimate a drop of Dmax during long-term storage, the sample was aged for 3 days at 50° C. and RH 40%. The sample was determined for Dmax before and after aging, obtaining a change of Dmax (ΔDmax).

ΔDmax=Dmax as coated−Dmax as aged

ΔDmax values of 0.5 or lower are practically acceptable, with values of 0.3 or lower being preferable.

The results are shown in Table 26. It is noted that when the nucleating agent was incompatible (or insoluble) in any of Formulations A, C and D, uniform coating was impossible and photographic properties could not be rated.

TABLE 26

| Sample | Nucleating agent | | | Photographic properties | | | |
|---|---|---|---|---|---|---|---|
| No. | No. | Addition procedure | Note | γ | ΔDmin | ΔDmax | Remarks |
| 1* | N-1 | Formulation A | | 14 | 0.03 | 1.3 | comparison |
| 2 | N-2 | Formulation A | | 15 | 0.03 | 1.1 | comparison |
| 3* | 3 | Formulation A | incompatible | — | — | — | comparison |
| 4 | 17 | Formulation A | incompatible | — | — | — | comparison |
| 5 | N-1 | Formulation B | | 13 | 0.02 | 0.8 | comparison |
| 6 | N-2 | Formulation B | | 13 | 0.02 | 0.9 | comparison |
| 7 | 3 | Formulation B | | 14 | 0.01 | 0.5 | invention |
| 8 | 17 | Formulation B | | 14 | 0.01 | 0.5 | invention |
| 9 | N-1 | Formulation C | incompatible | — | — | — | comparison |
| 10 | N-2 | Formulation C | incompatible | — | — | — | comparison |
| 11 | 3 | Formulation C | | 14 | 0.01 | 0.4 | invention |
| 12 | 17 | Formulation C | | 13 | 0.01 | 0.4 | invention |
| 13 | N-1 | Formulation D | incompatible | — | — | — | comparison |
| 14 | N-2 | Formulation D | incompatible | — | — | — | comparison |
| 15 | 2 | Formulation D | | 16 | 0 | 0.2 | invention |
| 16 | 3 | Formulation D | | 18 | 0 | 0.1 | invention |
| 17 | 10 | Formulation D | | 16 | 0 | 0.2 | invention |
| 18 | 17 | Formulation D | | 18 | 0 | 0.1 | invention |
| 19 | 22 | Formulation D | | 17 | 0 | 0.2 | invention |
| 20 | 25 | Formulation D | | 15 | 0 | 0.2 | invention |
| 21 | 29 | Formulation D | | 16 | 0 | 0.2 | invention |

Formulation A: methanol solution
Formulation B: solid dispersion with surfactant added
Formulation C: micelle dispersion with surfactant added
Formulation D: micelle dispersion without surfactant
*outside the scope of the invention It is seen from Table 26 that photothermographic elements exhibiting an ultrahigh contrast, low Dmax even after long-term storage, and good image retention upon printing to PS plates are obtained only when the nucleating agents within the scope of the invention are added by the procedure within the scope of the invention.

There have been described photothermographic elements exhibiting a high contrast, long-term storage stability, and no increase of Dmin upon printing to PS plates.

Japanese Patent Application Nos. 145059/1998 and 213487/1998 are incorporated herein by reference.

Reasonable modifications and variations are possible from the foregoing disclosure without departing from either the spirit or scope of the present invention as defined by the claims.

What is claimed is:

1. A photothermographic element, comprising a non-photosensitive organic silver salt, a photosensitive silver halide formed independent of the non-photosensitive organic silver salt, and a binder on a support, wherein a polymer latex constitutes at least 50% by weight of the binder in an image forming layer on one surface of said support containing the photosensitive silver halide, the image forming layer has been formed by applying a coating solution in which at least 60% by weight of a solvent is water, the image forming layer or another layer on the one surface of said support contains at least one compound selected from compounds of the following formulae (A) and (B) and has been formed by applying a coating solution having added thereto a water dispersion of said compound, formula (A)

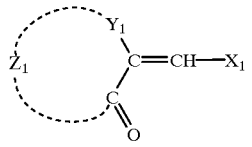

wherein $Z_1$ is a group of non-metallic atoms completing a 5- to 7-membered cyclic structure, $Y_1$ is —C(═O)— or —SO2—, $X_1$ is —O.(1/k)M or —S.(1/k)M, M is a cation, and k is the valence of M, formula (B)

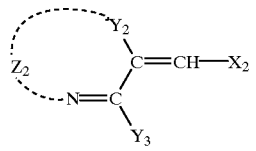

wherein $Z_2$ is a group of non-metallic atoms completing a 5- to 7-membered cyclic structure, $Y_2$ is —C(=O)— or —$S_2$—, $X_2$ is —O.(1/k)M or —S.(1/k)M, M is a cation, k is the valence of M, and $Y_3$ is hydrogen or an optionally substituted substituent selected from the group consisting of alkyl, aryl, heterocyclic, cyano, acyl, alkoxycarbonyl, aryloxycarbonyl, carbamoyl, amino, alkylamino, arylamino, heterocyclicamino, acylamino, sulfonamide, ureido, thioureido, imide, alkoxy, aryloxy, alkylthio, arylthio and heterocyclicthio.

2. The photothermographic element of claim 1 wherein the compound of formula (A) has at least 6 carbon atoms in total and the compound of formula (B) has at least 12 carbon atoms in total.

3. The photothermographic element of claim 1 wherein the at least one compound selected from compounds of formulae (A) and (B) has been added to the coating solution as a water dispersion free of a surfactant.

4. The photothermographic element of claim 1 wherein said polymer latex is a latex of a polymer having a glass transition temperature of −30° C. to 40° C.

5. The photothermographic element of claim 1 wherein the image forming layer or another layer on the one surface of said support contains a compound of the following formula (F):

(F)

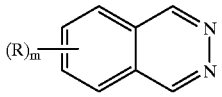

wherein R is an alkyl group preferably having 1 to 8 carbon atoms and m is an integer of 1 to 4.

6. The photothermograpic element of claim 1 wherein the image forming layer or another layer on the one surface of said support contains a hydrazine derivative of the following formula (H):

(H)

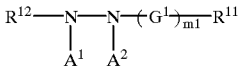

wherein $R^{12}$ is an aliphatic, aromatic or heterocyclic group, $R^{11}$ is hydrogen or a block group; $G^1$ is —CO—, —COCO—, —C(=S)—, —$SO_2$—, —SO—, —PO($R^{13}$)— or iminomethylene group; $R^{13}$ is independently selected from the same groups as defined for $R^{11}$; both $A^1$ and $A^2$ are hydrogen, or one of $A^1$ and $A^2$ is hydrogen and the other is a substituted or unsubstituted alkylsulfonyl, substituted or unsubstituted arylsulfonyl or substituted or unsubstituted acyl group; and ml is equal to 0 or 1, with the proviso that $R^{11}$ is an aliphatic, aromatic or heterocyclic group when m1 is 0.

7. The photothermographic element of claim 6, wherein $R^{11}$ is a block group selected from the group consisting of aliphatic groups, aromatic groups, heterocyclic groups, alkoxy, aryloxy, amino and hydrazino groups.

* * * * *